US011697942B2

(12) United States Patent
Pytlewski

(10) Patent No.: US 11,697,942 B2
(45) Date of Patent: Jul. 11, 2023

(54) TILE LIPPAGE CONTROL AND TILE SPACING SYSTEM AND METHOD THEREFORE

(71) Applicant: Walter Pytlewski, Post Falls, ID (US)

(72) Inventor: Walter Pytlewski, Post Falls, ID (US)

( * ) Notice: Subject to any disclaimer, the term of this patent is extended or adjusted under 35 U.S.C. 154(b) by 0 days.

(21) Appl. No.: 17/208,240

(22) Filed: Mar. 22, 2021

(65) Prior Publication Data

US 2022/0298807 A1 Sep. 22, 2022

(51) Int. Cl.
*E04F 21/00* (2006.01)
*E04F 21/22* (2006.01)

(52) U.S. Cl.
CPC ..... *E04F 21/0092* (2013.01); *E04F 21/22* (2013.01)

(58) Field of Classification Search
CPC ... E04F 21/0092; E04F 21/22; E04F 21/1844; E04F 13/0892; E04F 15/02005; E04F 21/1877
See application file for complete search history.

(56) References Cited

U.S. PATENT DOCUMENTS

| | | | | |
|---|---|---|---|---|
| 8,181,420 | B2 | 5/2012 | Torrents | |
| D678,039 | S * | 3/2013 | Psaila | D8/354 |
| 9,279,259 | B1 * | 3/2016 | Russo | E04F 21/0092 |
| 9,328,522 | B2 * | 5/2016 | Bordin | E04F 21/0092 |
| 9,470,002 | B2 | 10/2016 | Irvine | |
| 9,657,485 | B2 | 5/2017 | Meyers | |
| 9,874,032 | B1 | 1/2018 | Chen | |
| 10,407,923 | B2 | 9/2019 | Psaila | |
| 10,508,458 | B1 | 12/2019 | Charitou | |
| 10,538,925 | B2 | 1/2020 | Ghelfi | |
| 10,801,218 | B2 * | 10/2020 | Cipriani | E04F 15/02022 |
| 2006/0185269 | A1 | 8/2006 | Kufner | |
| 2006/0185319 | A1 * | 8/2006 | Kufner | E04F 21/22 52/749.11 |
| 2013/0067854 | A1 * | 3/2013 | Bordin | E04F 21/0092 52/749.11 |
| 2015/0211243 | A1 * | 7/2015 | Irvine | E04F 15/02 52/749.11 |
| 2016/0369518 | A1 * | 12/2016 | Sarajian | E04F 15/08 |
| 2018/0100315 | A1 | 4/2018 | Volponi | |
| 2019/0093372 | A1 * | 3/2019 | Russo | E04F 21/20 |
| 2019/0127994 | A1 | 5/2019 | Cipriani | |
| 2019/0242143 | A1 * | 8/2019 | Dahill | E04F 21/22 |
| 2019/0271167 | A1 * | 9/2019 | Ghelfi | E04F 21/0092 |
| 2019/0345724 | A1 * | 11/2019 | Sighinolfi | E04F 21/22 |
| 2019/0368207 | A1 * | 12/2019 | Charitou | E04F 15/02022 |

FOREIGN PATENT DOCUMENTS

| | | | | |
|---|---|---|---|---|
| AU | 2614100933 | | 9/2014 | |
| CN | 204139562 | | 2/2015 | |
| EP | 2952652 | B1 * | 4/2018 | E04F 21/0092 |
| EP | 3511484 | A1 * | 7/2019 | E04F 13/0862 |

(Continued)

*Primary Examiner* — Babajide A Demuren
(74) *Attorney, Agent, or Firm* — Randall Danskin P.S.

(57) ABSTRACT

A tile lippage control and tile spacing system provides a spacer post having a base member, a shaft, and a breakaway connection between the base member and the shaft; and a leveler that releasably and adjustably engages with the spacer post shaft, the leveler having a friction plate, a foot ring and an engager; and the leveler is both axially and rotatably engageable with the spacer post shaft.

11 Claims, 20 Drawing Sheets

(56) References Cited

FOREIGN PATENT DOCUMENTS

| | | | | | |
|---|---|---|---|---|---|
| JP | 2013204318 | A | * | 10/2013 | |
| WO | WO-2009022359 | A1 | * | 2/2009 | ..... E04F 21/0092 |
| WO | WO-2013033761 | A | * | 3/2013 | ..... E04F 15/02022 |
| WO | WO-2016189423 | A1 | * | 12/2016 | ..... E04F 21/0092 |
| WO | 2018172802 | | | 9/2018 | |
| WO | WO-2018172802 | A1 | * | 9/2018 | |

* cited by examiner

TILE LIPPAGE CONTROL AND TILE SPACING SYSTEM AND METHOD THEREFORE

TECHNICAL FIELD

The present invention relates generally to the field of construction, and more particularly to the field of surface coverings, and even more particularly to the field of tiles and the placement and installation of tiles on floor surfaces and wall surfaces. Still even more particularly the present invention relates to a device, system and method for accurately controlling the lippage during the installation of tiles, and accurately controlling spacing between adjacent tiles during installation.

BACKGROUND OF THE INVENTION

Tile lippage is a variation in the planar position of an exterior surface of a tile, relative to the planar position of an exterior surface of an adjacent tile. Tile lippage may be a safety hazard which may cause tripping on a walking surface, and also diminishes the aesthetic appearance of installed tiles. For those reasons, amongst others, eliminating tile lippage during the installation of tiles is perhaps the primary objective of artisans installing tiles.

Known prior art disclose a variety of devices for leveling tiles which are used for bringing the upper/exposed surfaces of a plurality of tiles into the same plane. In the laying of tiles (on a floor surface, or a wall surface, or otherwise) the underlying surface may not be perfectly planar due to irregularities in the underlying supporting surface, and/or irregularities in the distribution of adhesive substrates. In order to make the upper/exposed surfaces of the tiles coplanar, leveling devices are used.

Known tile leveling devices, generally fall into two categories: (1) threaded tighteners which generally have two components, each component having one half of a pair of mating threads, so that axial rotation of one component, relative to the other component, causes the two components to move along the engaged threads axially toward one another so as to "squeeze" the adjacent tiles therebetween, responsively eliminating tile lippage and leveling the tiles; and (2) ramp type levelers which also generally have two components, one component defining a predetermined fixed opening, and a second component defining a stepped ramp, that is inserted at least partially into the predetermined fixed opening, and movement of the first component, along the stepped ramp brings the two components closer to one another, similarly "squeezing" the adjacent tiles therebetween, responsively eliminating lippage and leveling a tiles. Ramp type levelers also generally require two hands to utilize, (one hand to hold the first component, and the second hand to handle the second component) which can exacerbate back issues for installers.

Perhaps second, only to eliminating tile lippage, there is the need for accurate and consistent spacing between adjacent tiles. Closely and consistently spaced tiles provide linear, and parallel, grout lines which provide aesthetic appeal, and minimize moisture absorption. Maintaining accurate and consistent spacing between adjacent tiles, especially when tiles are laid over a vast planar area (such as a large floor, or large wall) has always been, and remains difficult. The presence of irregular, nonlinear, non-consistent grout lines is evidence of amateur the installation.

Known devices for controlling tile lippage, and maintaining accurate spacing between adjacent tiles have a variety of drawbacks.

One known drawback is that axial rotation of tighteners is time-consuming, and subjects installers to repetitive stress injuries, such as, but not limited to, carpal tunnel syndrome. Each tightening device needs to be axially oriented with the second component, the first component needs to be repeatedly axially rotated relative to the second component to the appropriate tension, the installer needs to ensure the tightening of the first component does not cause the adjacent tiles to move laterally relative to one another which causes the spacing therebetween to change; the tightening of adjacent devices may alter the tension of previously tightened devices; and for removal, the tightener needs to again be axially rotated to remove the first component from the second. As described, use of known axial rotation tighteners is time-consuming, and duplicative because the axial rotation must occur twice; once for tightening, and once for loosening. Thereafter, the first component that is extending generally outwardly from between the adjacent tiles, must be separately removed and/or fractured at a position below the top surface of the tiles so that the component does not to interfere with installation of grout.

Known tile leveling devices that use both axial rotation, and stepped ramps both tend to exert a lateral component of force upon the tiles as the device is tightened downwardly upon the tiles. The lateral component of force tends to force the tiles under the device apart from one another which can, and frequently does, cause joint lines to be unequal and non-linear which negatively affects the aesthetic appearance of the finished product and may make the finished product more subject to cracking, the loss and moisture absorption.

A still further known drawback of known tile leveling devices is that the portion/component of the device that is positioned at least partially under and between the adjacent tiles must be cut or otherwise fractured to be removed. The cut location/fracture location must be vertically below the exterior/exposed surface of the adjacent tiles, and within the space between the tiles, so that the fracture location may be sufficiently covered by, and obscured by, grout that is thereafter placed within the space between the tiles. Generally, this cutting/fracturing requires a separate tool, and a separate process after the substrate adhesively securing the tiles to the supporting surface has hardened/cured and the first component of the tile leveling device has been removed/disconnected from the second component. This cutting/fracturing is a third time-consuming "step" in the laying of tiles.

What is needed is a tile leveling device which accurately and consistently controls the lippage and simultaneously accurately and consistently controls tile spacing. What is further needed is a tile leveling device which does not subject to user to repetitive stress injuries, eliminates duplicative work, and can be installed/operated with one hand. Further still, what is needed is a device that saves time, makes tile installation more efficient, and a device that intentionally fractures/breaks at a predetermined location that is below an exterior/exposed surface of the tile so that grout maybe installed thereover.

The present invention overcomes various of the aforementioned drawbacks to known prior art the leveling devices, and provides several advantages over the prior art references, and practices utilized, heretofore. More specifically, the present invention is a the lippage control device and tile spacing control device that is both axially slidably and threadably rotatably engageable with a base member that has a predetermined breakaway point that is positioned vertically below the exterior/exposed surface of the adjacent tile.

SUMMARY OF THE INVENTION

The present invention is a system and method for controlling lippage of tiles and for spacing tiles, and generally provides a spacer post, and a leveler, and the leveler is both axially slidably and rotationally threadably engaged with the spacer post.

A first aspect of the present invention relates to a tile lippage control and tile spacing system comprising a spacer post having a base member, a shaft, and a breakaway connection between the base member and the shaft; and a leveler that releasably and adjustably engages with the spacer post shaft, the leveler having a friction plate, a foot ring and an engager; and the leveler is both axially and rotatably engageable with the spacer post shaft.

A further aspect of the present invention relates to a tile lippage control and tile spacing system wherein the spacer post is formed of a homopolymer material, or plastic material, such as, but not limited to Acetal, polyoxymethylene, ABS, ABS-PC, Nylon, glass filled nylon, Vinyl, HDPE, Poly-Propylene and plastics having glass fibers.

A further aspect of the present invention relates to a tile lippage control and tile spacing system wherein the base member, the shaft, and the breakaway connection are integral with the spacer post.

A further aspect of the present invention relates to a the lippage control and tile spacing system wherein the leveler both axially slidably, and rotationally threadably, engages with the spacer post shaft.

A further aspect of the present invention relates to a the lippage control and tile spacing system wherein the base member is generally planar and has a top surface, a bottom surface, a peripheral edge extending thereabout, and a plurality of spacedly arrayed through holes are defined in the base member and communicate between the top surface and the bottom surface, and a predetermined surface feature is carried on the top surface and extends generally vertically upwardly therefrom, and the predetermined surface feature has a top end portion, a predetermined height dimension between the top end portion and the top surface of the base member, a predetermined a thickness dimension, a predetermined width dimension, and a predetermined position on of the base member.

A further aspect of the present invention relates to a tile lippage control and tile spacing system wherein the base member generally planar and has a top surface, a bottom surface, a peripheral edge extending thereabout, and a plurality of spacedly arrayed through holes are defined in the base member and communicate between the top surface and the bottom surface, and plural predetermined surface features are carried on the top surface and extend generally vertically upwardly therefrom, and each of the plural predetermined surface features have a top end portion, a predetermined height dimension, a predetermined a thickness dimension, and a predetermined position relative to the others of the plural predetermined surface features.

A further aspect of the present invention relates to a the lippage control and tile spacing system wherein plural predetermined surface features on the top surface of the base member are aligned linearly.

A further aspect of the present invention relates to a tile lippage control and tile spacing system wherein plural predetermined surface features on the top surface of the base member are aligned angularly to others of the plural predetermined surface features.

A further aspect of the present invention relates to a tile lippage control and tile spacing system wherein plural predetermined surface features on the top surface of the base member are aligned in intersecting lines.

A further aspect of the present invention relates to a tile lippage control and tile spacing system wherein plural predetermined surface features on the top surface of the base member each have a predetermined thickness dimension (not tile spacing width) that is between approximately about 0.050 inch and about 0.125 inch.

A further aspect of the present invention relates to a tile lippage control and tile spacing system wherein plural predetermined surface features on the top surface of the base member each have a predetermined height dimension that is between approximately about 0.075 inch and about 0.125 inch.

A further aspect of the present invention relates to a the lippage control and tile spacing system wherein plural predetermined surface features on the top surface of the base member provide predetermined spacing between adjacent tiles.

A further aspect of the present invention relates to a tile lippage control and tile spacing system wherein the base member and the shaft are interconnected.

A further aspect of the present invention relates to a tile lippage control and tile spacing system further comprising a spacer member between the base member and the shaft, and the spacer member is generally planar and has a first side and a second side with a predetermined thickness dimension therebetween, a first lateral edge, a second lateral edge, a top end portion and a bottom end portion with a predetermined height dimension therebetween, and the top end portion is structurally interconnected to a bottom end portion of the shaft, and the bottom end portion of the spacer member is interconnected with the top end portions of plural predetermined surface features on the top surface of the base member.

A further aspect of the present invention relates to a tile lippage control and tile spacing system wherein the breakaway connection is between the plural surface features on the base member, and a bottom end portion of the shaft, and the breakaway connection provides a predetermined and intentional fracture location where the spacer member and shaft are separable from the base member.

A further aspect of the present invention relates to a tile lippage control and tile spacing system wherein the breakaway connection is between the bottom end portion of the spacer member and the top end portion of plural predetermined surface features of the base member, and the breakaway connection provides a predetermined and intentional fracture location where the spacer member and shaft are separable from the base member.

A further aspect of the present invention relates to a tile lippage control and tile spacing system wherein the shaft is generally cylindrical and elongate and has a top end portion, a bottom end portion, an exterior circumferential surface, a diameter and defines a longitudinal axis, and the shaft is interconnected with the breakaway connection, and a plurality of predetermined and spacedly arrayed surface features are defined on the exterior circumferential surface of the shaft between the top end portion and the bottom end portion, and the plurality of predetermined and spacedly arrayed surface features include a plurality of vertically aligned and vertically spaced apart partial threads, each of the partial threads having a beveled first end portion and a second end portion, a top surface, a bottom surface, a predetermined thickness and a predetermined slope relative to the longitudinal axis, and the plurality of predetermined and spacedly arrayed surface features on the shaft further include an axial slide channel defined on the exterior circumferential surface of the shaft, and the axial slide channel is adjacent to the beveled first end portion of each of the plurality of partial threads.

A further aspect of the present invention relates to a tile lippage control and tile spacing system wherein the shaft is generally cylindrical and elongate and has a top end portion, a bottom end portion, an exterior circumferential surface, a diameter and defines a longitudinal axis, and the shaft is interconnected with the breakaway connection at plural spacedly arrayed locations, and a plurality of predetermined and spacedly arrayed surface features are defined on the exterior circumferential surface of the shaft between the top end portion and the bottom end portion, and the plurality of predetermined and spacedly arrayed surface features include two circumferentially spaced apart groupings of a plurality of vertically aligned and vertically spaced apart partial threads, each of the partial threads having a beveled first end portion and a second end portion, a top surface, a bottom surface and a predetermined slope relative to the longitudinal axis, and two circumferentially spaced apart axial slide channels are defined on the exterior circumferential surface of the shaft, and each of the axial slide channels space apart the circumferentially spaced apart groupings of the plurality of partial threads from one another.

A further aspect of the present invention relates to a the lippage control and tile spacing system wherein the friction plate is annular and has a top surface, a bottom surface, an outer circumferential edge having an outer diameter, a medial hole having an inner circumferential edge defining an inner diameter, an axis, and an O-ring groove is defined in the bottom surface of the friction plate to carry an O-ring therein; and an annular slide track is defined in the top surface of the friction plate for axial rotational slidable engagement with the foot ring, and the annular slide track has a retaining lip at an edge portion to maintain the foot ring in axially rotational slidable engagement with the slide track.

A further aspect of the present invention relates to a tile lippage control and tile spacing system wherein the foot ring is annular and has a top surface, a bottom surface that frictionally slidably communicates with the friction plate slide track, an outer circumferential edge having an outer diameter, a medial hole having an inner circumferential edge and an inner diameter; and an axis; and the foot ring is interconnected with the engager.

A further aspect of the present invention relates to a tile lippage control and tile spacing system further comprising plural spacedly arrayed engager legs structurally carried on the top surface of the foot ring, and each of the plural engager legs has a top end portion, a spaced apart bottom end portion interconnected with the top surface of the foot ring, opposing lateral side portions and a predetermined height dimension between the top end portion and the bottom end portion; and the top portion of each of the plural engager legs is interconnected with the engager; and axial rotation of the engager responsively causes axial rotation of the foot ring.

A further aspect of the present invention relates to a tile lippage control and tile spacing system wherein the engager has a body that is interconnected with the foot ring, and the body has a top surface, a bottom surface, a medial cylindrical portion, an outer circumferential edge that defines gripping features to enhance gripping by a user, and the medial cylindrical portion has a barrel portion that has an outer circumferential surface and the barrel portion defines a medial channel extending axially therethrough that defines an axis, and has an inner circumferential surface and an inner diameter and the inner circumferential surface defines a plurality of predetermined and spacedly arrayed surface features, and the plurality of predetermined and spacedly arrayed surface features include a grouping of plural vertically aligned and vertically spaced apart, partial threads, each partial thread having a beveled first end portion and a second end portion, a top surface, a bottom surface, a predetermined thickness and a predetermined slope relative to the axis, and an axial slide channel is defined in the interior circumferential surface of the medial channel, and the axial slide channel is adjacent to the beveled first end portion of each of the plural vertically aligned and vertically spaced apart partial threads, and an alignment indicator is defined on the top surface of the body and the alignment indicator identifies the location of the predetermined surface features within the medial channel.

A further aspect of the present invention relates to a tile lippage control and tile spacing system and further comprises two circumferentially spaced apart groupings of plural vertically aligned and vertically spaced apart partial threads defined in the inner circumferential surface of the medial channel.

A further aspect of the present invention relates to a tile lippage control and tile spacing system and further comprises two circumferentially spaced apart axial slide channels defined in the inner circumferential surface of the medial channel and each of the two circumferentially spaced apart axial slide channels separates the two groupings of vertically aligned and vertically spaced apart, partial threads, circumferentially from one another.

A still further aspect of the present invention relates to a tile lippage control and tile spacing system comprising: a spacer post having a base member, a shaft and a breakaway connection between the base member and the shaft; the base member is generally planar and has a top surface, a bottom surface, a peripheral edge extending thereabout, and a plurality of spacedly arrayed through holes are defined in the base member and communicate between the top surface and the bottom surface, and plural predetermined surface features are carried on the top surface and extend generally vertically upwardly therefrom, each of the plural predetermined surface features having a top end portion, a predetermined height dimension between the top end portion and the top surface of the base member, a predetermined a thickness dimension, a predetermined width dimension, and a predetermined position relative to the others of the plural predetermined surface features; and the breakaway connection is between a bottom end portion of the shaft and the top end portion of plural predetermined surface features of the base member, and the breakaway connection provides a predetermined and intentional fracture location where the shaft is separable from the base member; the shaft is generally cylindrical and elongate and has a top end portion, a bottom end portion, an exterior circumferential surface, a diameter and defines a longitudinal axis, and a plurality of predetermined and spacedly arrayed surface features are defined on the exterior circumferential surface between the top end portion and the bottom end portion, and the plurality of predetermined and spacedly arrayed surface features include two circumferentially spaced apart groupings of a plurality of vertically aligned and vertically spaced apart partial threads, each of the partial threads having a beveled first end portion and a second end portion, a top surface, a bottom surface, a predetermined thickness and a predetermined slope relative to the longitudinal axis, and two circumferentially spaced apart axial slide channels are defined on the exterior circumferential surface of the shaft, and each of the two axial slide channels space apart the two groupings of the plurality of partial threads from one another; a leveler that releasably and adjustably engages with the spacer post, the leveler having a friction plate, a foot ring and an engager; the friction plate is annular and has a top surface, a bottom surface, an outer circumferential edge defining an outer diameter, a medial hole having an inner circumferential edge defining an inner diameter, an axis, and an O-ring groove is defined in the bottom surface to carry an O-ring therein, and an annular slide track is defined in the top surface for slidable engagement with the foot ring, the annular slide track having a radially extending retaining lip at a circumferential edge to maintain the foot ring in axially rotational slidable engagement with the slide track; the foot ring is annular and has a top surface, a bottom surface that frictionally slidably communicates with the slide track of the friction plate, an outer circumferential edge defining an outer diameter and having a lip, a medial hole having an inner circumferential edge defining an inner diameter, and an axis, and plural spaced apart engager legs are structurally carried on the top surface, and each of the plural spaced apart engager legs has a bottom end portion interconnected with the top surface of the foot ring, a top end portion, opposing lateral side portions, and a predetermined height dimension between the top end portion and the bottom end portion; and the engager has a body that is structurally interconnected with the top end portion of each of the plural spaced apart engager legs, and the body has a top surface, a bottom surface, a medial cylindrical portion, and an outer circumferential edge that defines gripping features to enhance gripping by a user, and each of the gripping features has a dimensionally thickened edge portion, and the medial cylindrical portion has a barrel portion that defines a medial channel that defines an axis and has an interior diameter, and the barrel portion has an outer circumferential surface and an inner circumferential surface within the medial channel, and the inner circumferential surface defines a plurality of predetermined and spacedly arrayed surface features, and the plurality of predetermined and spacedly arrayed surface features include two circumferentially spaced apart groupings of a plurality of vertically aligned and vertically spaced apart, partial threads, each partial thread having a beveled first end portion and a second end portion, a top surface, a bottom surface, a predetermined thickness and a predetermined slope relative to the axis of the medial channel, and two axial slide channels are defined in the interior circumferential surface of the medial channel, and the two axial slide channels are circumferentially spaced apart from one another, and an alignment indicator is defined on the top surface of the body and the alignment indicator identifies the location of the predetermined surface features within the medial channel; and the leveler is both axially slidably and rotatably threadably engageable with the spacer post shaft.

An even still further aspect of the present invention is a the lippage control and tile spacing system and further comprises a spacer member between the bottom end portion of the shaft and the top end portions of plural predetermined surface features of the base member, and wherein the spacer member is generally planar and has a first side and a second side with a predetermined thickness dimension therebetween, a first lateral edge, a second lateral edge, a top end portion and a bottom end portion with a predetermined height dimension therebetween, and the top end portion is structurally interconnected to the bottom end portion of the shaft, and the bottom end portion of the spacer communicates with the top end portions of the predetermined surface features of the base member to form the breakaway connection.

An even still further aspect of the present invention is a tile lippage control and tile spacing system and further comprises a radially enlarged shoulder carried at the bottom end portion of the shaft, and the radially enlarged shoulder is structurally interconnected with the top end portion of the spacer member.

An even still further aspect of the present invention is a method for controlling tile lippage and controlling tile spacing in the setting of tiles in a substrate, comprising the steps: providing a surface that is at least partially covered with the substrate; providing at least two tiles to be placed adjacent one another in the substrate with a predetermined distance between adjacent edge portions of the at least two tiles; providing a spacer post having a base member, a shaft, and a breakaway connection between the shaft and the base member; the base member is generally planar and has a top surface, a bottom surface, a peripheral edge extending thereabout, and a plurality of spacedly arrayed through holes are defined in the base member and communicate between the top surface and the bottom surface, and plural predetermined surface features are carried on the top surface and extend generally vertically upwardly therefrom, each of the plural predetermined surface features having a top end portion, a predetermined height dimension, a predetermined a thickness dimension, a predetermined width dimension and a predetermined position relative to the others of the predetermined surface features; and the breakaway connection is between a bottom end portion of the shaft and the top end portion of plural predetermined surface features of the base member, and the breakaway connection provides a predetermined and intentional fracture location where the shaft is separable from the base member; the shaft is generally cylindrical and elongate and has a top end portion, a bottom end portion, an exterior circumferential surface, a diameter and defines a longitudinal axis, and a plurality of predetermined and spacedly arrayed surface features are defined on the exterior circumferential surface between the top end portion and the bottom end portion, and the plurality of predetermined and spacedly arrayed surface features include two circumferentially spaced apart groupings of a plurality of vertically aligned and vertically spaced apart partial threads, each of the partial threads having a beveled first end portion and a second end portion, a top surface, a bottom surface, a predetermined thickness and a predetermined slope relative to the longitudinal axis, and two circumferentially spaced apart axial slide channels are defined on the exterior circumferential surface of the shaft, and each of the two axial slide channels space apart the two groupings of the plurality of partial threads from one another; placing a first tile in the substrate and in a predetermined position; placing the base member of the spacer post in the substrate and positioning a portion of the generally planar base member under one edge of the placed first the so that some amount of the substrate flows into and through the plurality of spacedly arrayed through holes defined in the generally planar base portion and an edge portion of the placed first the is in direct frictional contact with the predetermined surface features carried on the top surface of the generally planar base portion; and the shaft extends vertically upwardly (perpendicularly outwardly)

adjacent the edge of the first placed tile; placing a second tile in the substrate and immediately adjacent the predetermined surface features carried on the top surface of the generally planar base portion of the base member that was previously placed in the substrate, and at least partially underneath the edge of the first placed tile, and aligning the second tile immediately adjacent the predetermined surface features so that a predetermined thickness dimension of each of the predetermined surface features provides spacing between the first and second placed tiles, and so that the shaft extends vertically upwardly (perpendicularly outwardly) from the space between the first and second placed tiles; providing a leveler that releasably and adjustably engages with the spacer post shaft, the leveler having a friction plate, a foot ring and an engager; and wherein the friction plate is annular and has a top surface, a bottom surface, an outer circumferential edge defining an outer diameter, a medial hole having an inner circumferential edge defining an inner diameter, an axis, and an O-ring groove is defined in the bottom surface to releasably carry a friction enhancing and scuff resistant O-ring therein, and an annular slide track is defined in the top surface for slidable engagement with the foot ring, the annular slide track having a radially extending retaining lip at a circumferential edge to maintain the foot ring in axially rotational slidable engagement with the slide track; the foot ring is annular and has a top surface, a bottom surface that frictionally slidably communicates with the slide track of the friction plate, an outer circumferential edge defining an outer diameter having a lip, a medial hole having an inner circumferential edge defining an inner diameter, and an axis, and plural spaced apart engager legs are structurally carried on the top surface, and each of the plural spaced apart engager legs has a bottom end portion interconnected with the top surface of the foot ring, and the top end portion, opposing lateral side portions and a predetermined height dimension between the top and portion and the bottom end portion; and the engager has a body that is structurally interconnected with the top portion of each of the plural spaced apart engager legs, and the body has a top surface, a bottom surface, a medial cylindrical portion and an outer circumferential edge that defines gripping features to enhance gripping by a user, and each of the plural spaced apart gripping features has a dimensionally thickened edge portion, and medial cylindrical portion has a barrel portion that defines a medial channel having an axis, and that has an interior diameter, and the barrel portion has an outer circumferential surface and an inner circumferential surface within the medial channel, and the inner circumferential surface defines a plurality of predetermined and spacedly arrayed surface features, and the plurality of predetermined and spacedly arrayed surface features include two circumferentially spaced apart groupings of a plurality of vertically aligned and vertically spaced apart, partial threads, each partial thread having a beveled first end portion and a second end portion, a top surface, a bottom surface, a predetermined thickness and a predetermined slope relative to the axis of the medial channel, and two axial slide channels are defined in the interior circumferential surface of the medial channel, and the two axial slide channels are circumferentially spaced apart from one another, and an alignment indicator is defined on the top surface of the body and the alignment indicator identifies the location of the predetermined surface features within the medial channel; positioning the leveler adjacent above the top end portion of the spacer post shaft so that the leveler axis is coaxially aligned with the shaft axis and so that the circumferentially spaced groupings of the plurality of vertically aligned and vertically spaced apart partial threads defined on the shaft are axially aligned with the axial slide channels defined in the interior circumferential surface of the engager, and axially slidably engaging the leveler onto the spacer post shaft and moving the leveler axially along the spacer post shaft until the O-ring carried on the bottom surface of the friction plate contacts the top/exposed surface of both the first and the second placed tiles; and axially rotating the engager about the spacer post shaft a partial turn so that the circumferentially spaced groupings of the plurality of vertically aligned and vertically spaced apart partial threads defined on the shaft threadably engage with the circumferentially spaced groupings of the plurality of vertically aligned and vertically spaced apart partial threads defined on the interior circumferential surface of the medial channel of the engager, so that the foot ring axially rotates within the slide track defined in the top surface of the friction plate, while the friction plate remains stationary on the first and second placed tiles so as to not mar/scuff/damage/move the tiles, and to not exert lateral forces on the tiles, and the leveler and friction plate are moved vertically downwardly along the spacer post shaft into closer proximity to the base member with the first and second placed tiles therebetween, responsively reducing lippage between the first and second placed tiles while maintaining spacing between the first and second placed tiles: allowing an amount of time to pass to allow the substrate to harden/cure and to positionally secure the first and second placed tiles in the substrate and at the desired spacing; intentionally striking the leveler and spacer post shaft with a blow (an oblique blow) sufficient to cause the spacer post shaft to separate from the base member at the break-away connection between the shaft and the base member, and permanently leaving the base member within the hardened/cured substrate below the adjacent first and second placed tiles; placing grout in the space between the first and second placed toes to fill the space and cover the portion of the breakaway connection remaining between the first and second placed tiles; and removing the separated shaft from the leveler so that the leveler may be reused.

An even still further aspect of the present invention is a tile lippage control and tile spacing system further comprising a base member that defines a plurality of spacedly arrayed through holes through which grout and/or substrate material may pass; and the base member permanently remains at least partially underneath an adjacent tile after the breakaway connection is broken.

An even still further aspect of the present invention is a tile spacing and tile alignment system comprising a base member that is generally planar and has a top surface, a bottom surface, a peripheral edge extending thereabout, and a plurality of spacedly arrayed through holes are defined in the base member and communicate between the top surface and the bottom surface, and plural predetermined surface features are carried on the top surface and extend generally vertically upwardly therefrom, and each of the plural predetermined surface features have a top end portion, a predetermined height dimension, a predetermined a thickness dimension, and a predetermined position relative to the others of the plural predetermined surface features; and the base member permanently remains at least partially under, and permanently between adjacent tiles when the tile tiles are placed in an underlying substrate on a supporting surface; and the plural predetermined surface features on the top surface of the base member provide predetermined spacing between, and alignment of, adjacent tiles as the tiles are placed in the substrate.

An even still further aspect of the present invention is a tile spacing and tile alignment system wherein the leveler is rotated axially upon the spacer post shaft less than one full axial rotation to apply downward pressure upon the tiles thereunder to control the tile lippage.

These and other aspects of the present invention will be discussed in greater detail hereinafter.

BRIEF DESCRIPTION OF THE DRAWINGS

Preferred embodiments of the present invention are described below with reference to the following accompanying drawings.

DETAILED DESCRIPTION OF THE PREFERRED EMBODIMENTS

Figure 1:
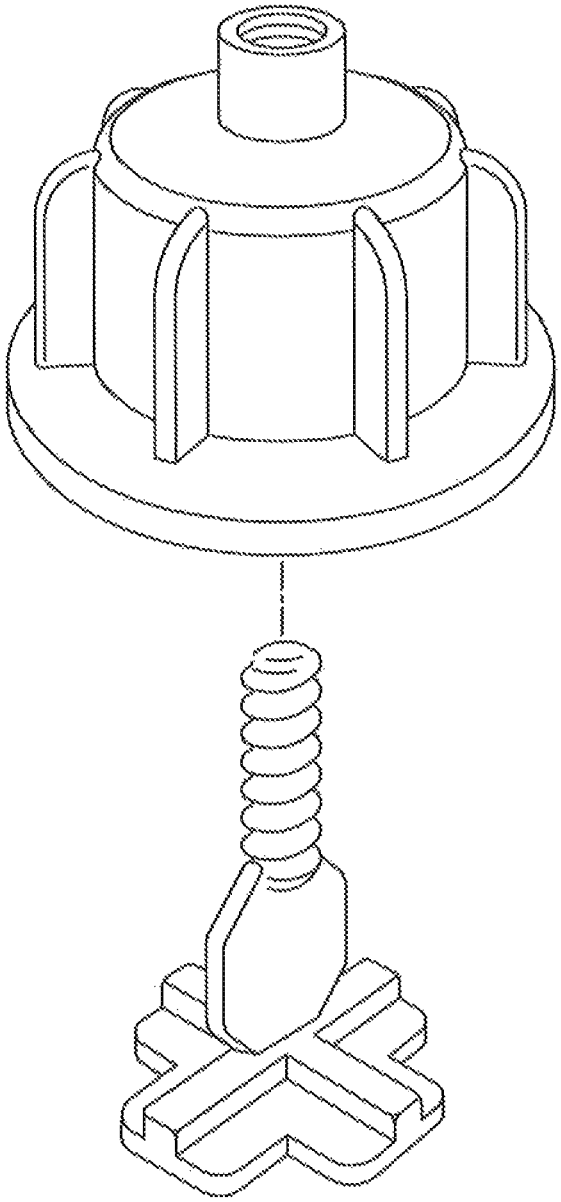
FIG. 1 (PRIOR ART)
FIG. 1 is a perspective top and side view of a prior art axially threaded tile lippage control device.
Figure 2:
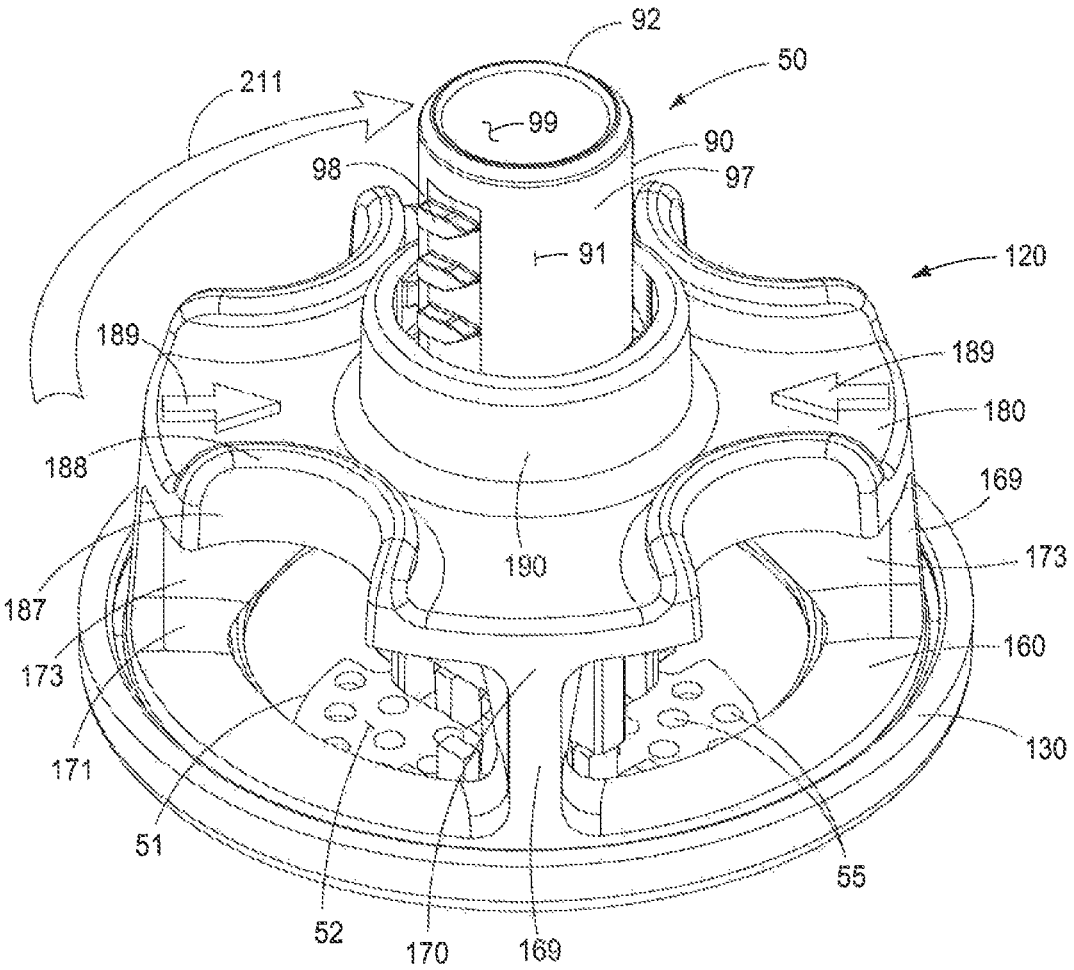
FIG. 2 is a perspective top and side view of the instant invention showing the leveler engaged with the spacer post.
Figure 3:
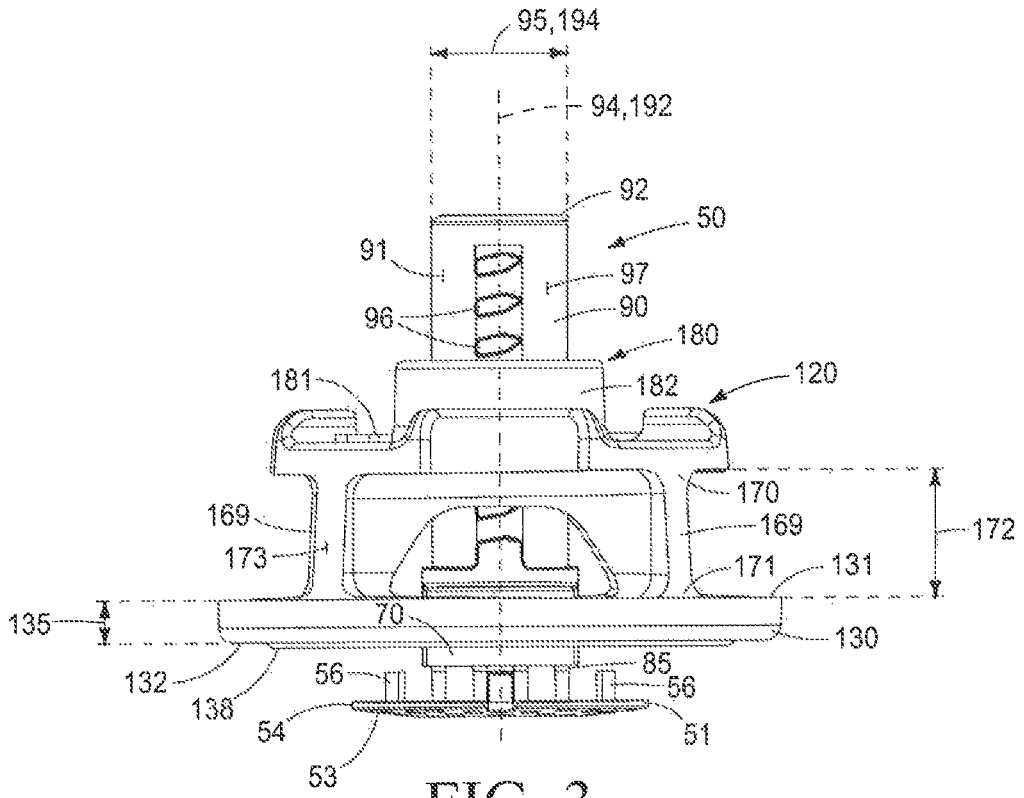
FIG. 3 is an orthographic side view of the invention of FIG. 2.
Figure 4:
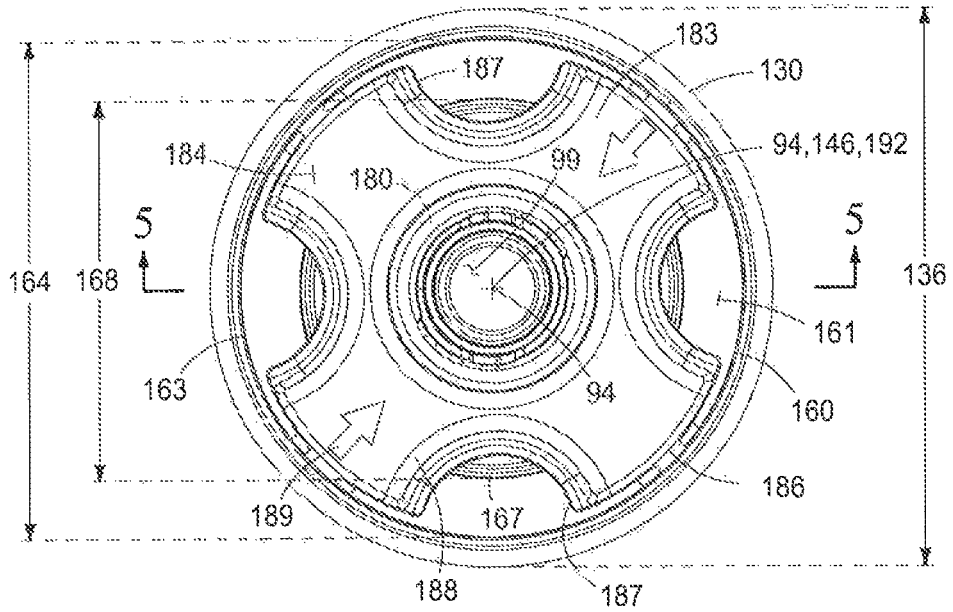
FIG. 4 is a top plan view of the invention of FIG. 2.
Figure 5:
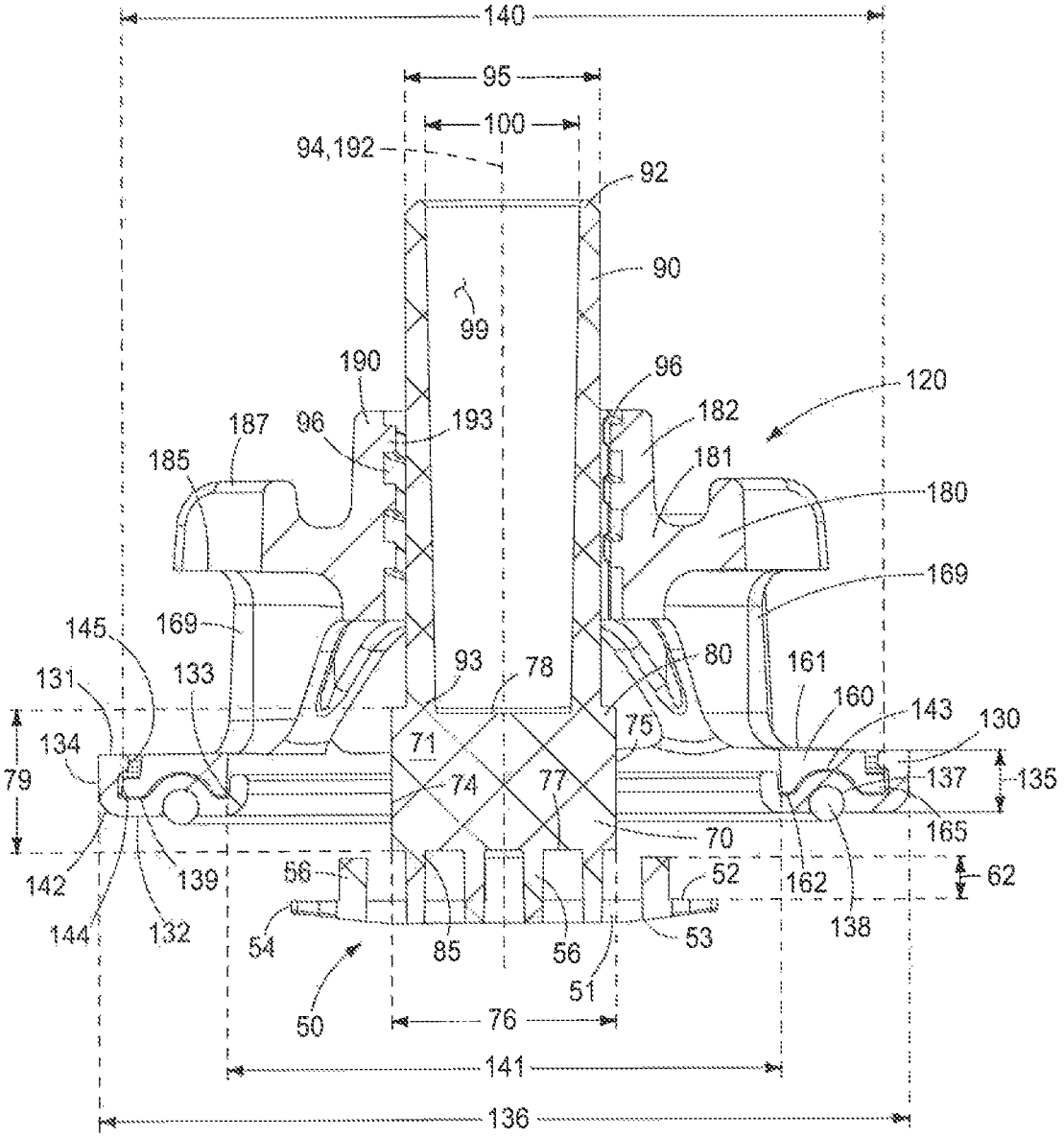
FIG. 5 is an orthographic cross section view taken on line 5-5 of FIG. 4.
Figure 6:
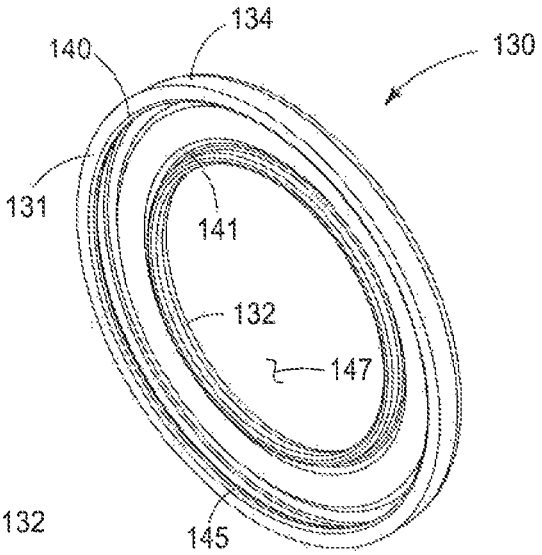
FIG. 6 is a perspective top and edge view of the friction plate.
Figure 7:
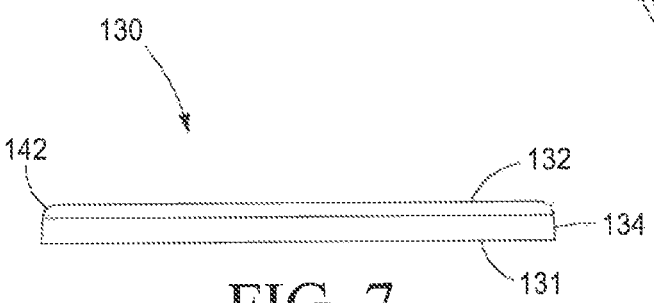
FIG. 7 is an orthographic inverted side view of the friction plate of FIG. 6.
Figure 8:
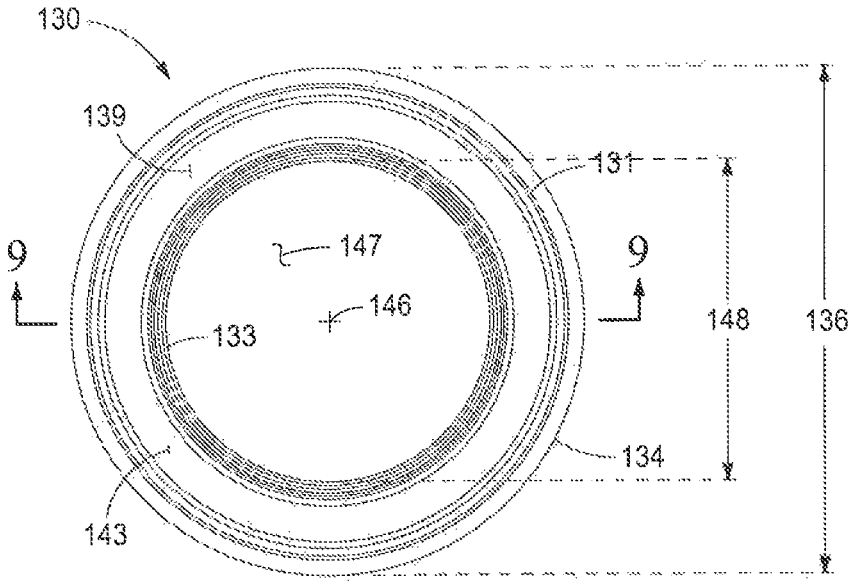
FIG. 8 is a top plan view of the friction plate of FIG. 6.
Figure 9:
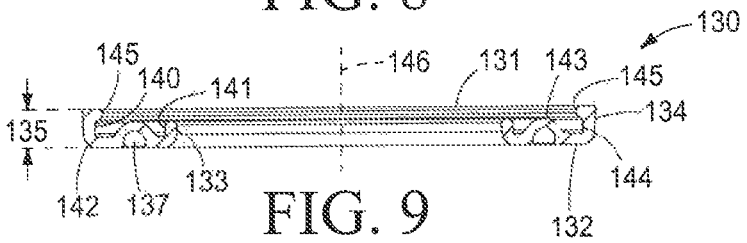
FIG. 9 is an orthographic cross section view of the friction plate taken on line 9-9 of FIG. 8.

This disclosure of the invention is submitted in furtherance of the Constitutional purposes of the U.S. Patent Laws "to promote the progress of" science and useful arts (Article I, Section 8).

Referring now to the drawings, the present invention relates to a device, a system, and a method for accurately controlling the lippage and accurately controlling the spacing during the installation of said tiles. As seen in the drawings, the invention generally provides a spacer post 50 and a leveler 120 that are both axially slidably, and rotationally threadably, engageable with one another. (FIGS. 2-5).

Figure 13:
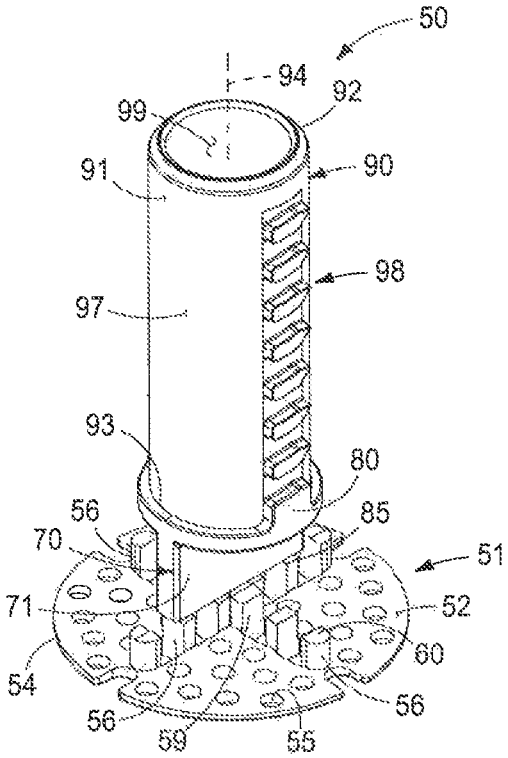
FIG. 13 is a perspective top and side view of the spacer post and base member, the base member having a four corner configuration of the plurality of predetermined surface features.
Figure 14:
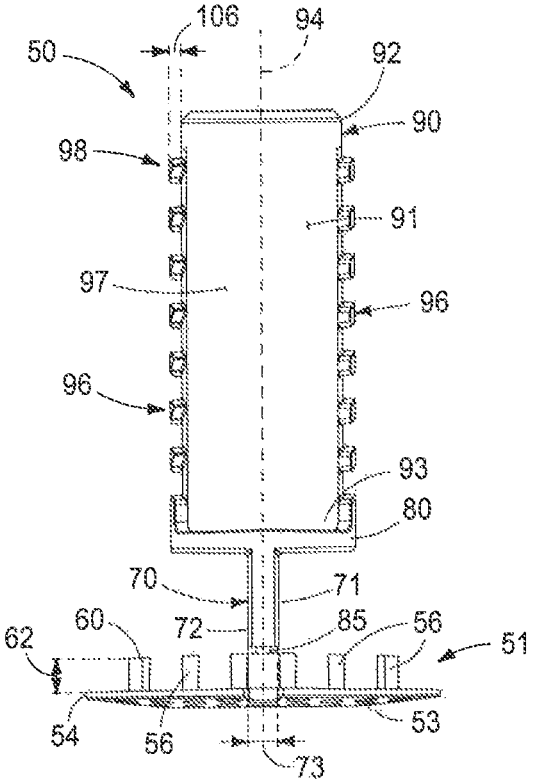
FIG. 14 is an orthographic side view of the spacer post and base member of FIG. 13, showing the axial slide channel.
Figure 15:
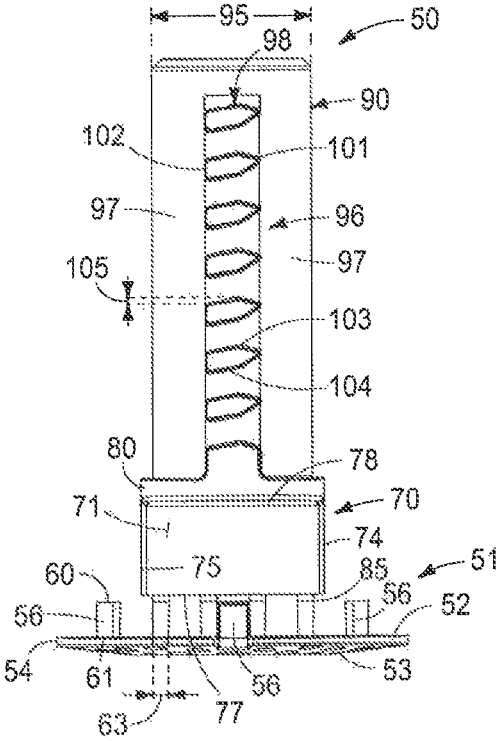
FIG. 15 is an orthographic side view of the spacer post and base member of FIG. 14, rotated axially 90° to show the plurality of vertically aligned and vertically spaced apart partial threads.

Best shown in FIGS. 13-15, the spacer post 50 generally provides a base member 51, a spacer member 70, a breakaway connection 85, and a shaft 90.

Figure 16:
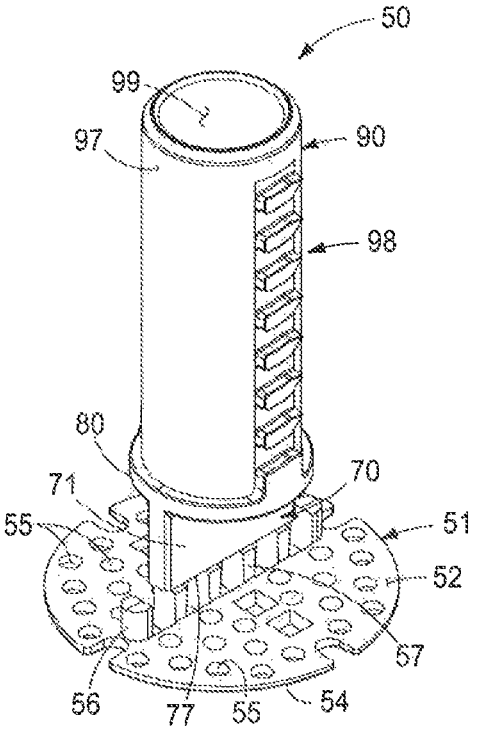
FIG. 16 is a perspective top and side view of the spacer post, and base member, the base member having a linear configuration of the plurality of predetermined surface features.
Figure 17:
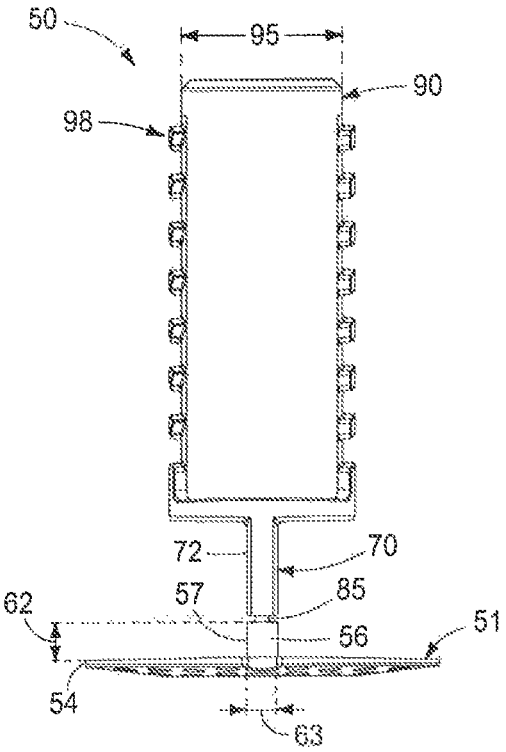
FIG. 17 is an orthographic side view of the spacer post and base member of FIG. 16, showing the axial slide channel.
Figure 18:
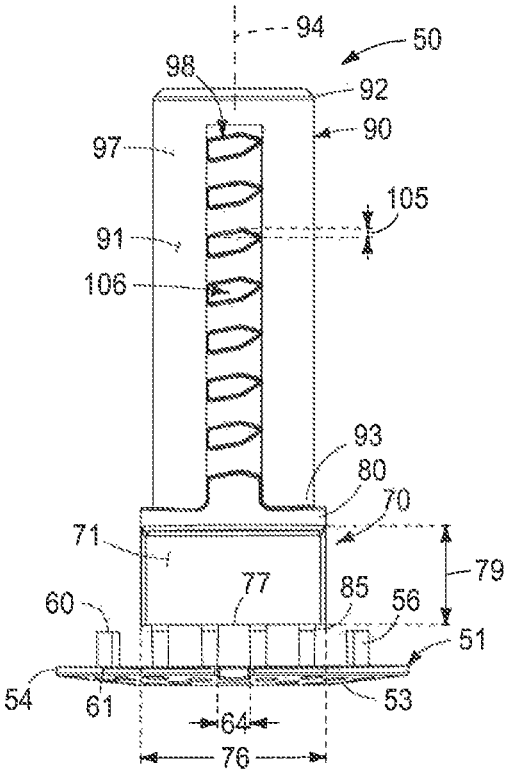
FIG. 18 is an orthographic side view of the spacer post and base member of FIG. 17, rotated axially 90° to show the plurality of vertically aligned and vertically spaced apart partial threads
Figure 19:
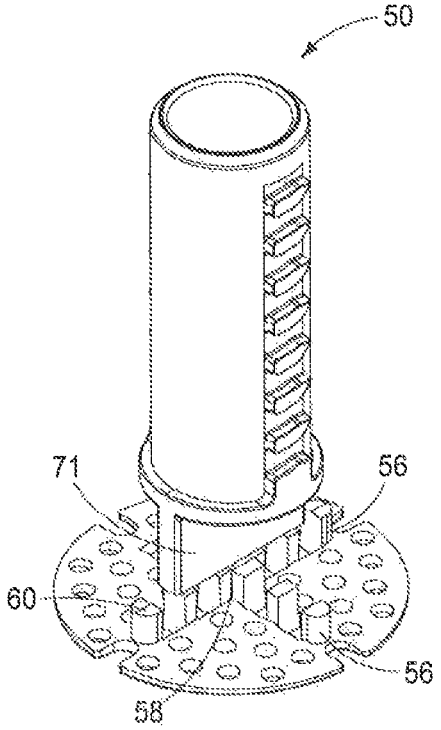
FIG. 19 is a perspective top and side view of the spacer post, and base member, the base member having a "T" configuration of the plurality of predetermined surface features.
Figure 20:
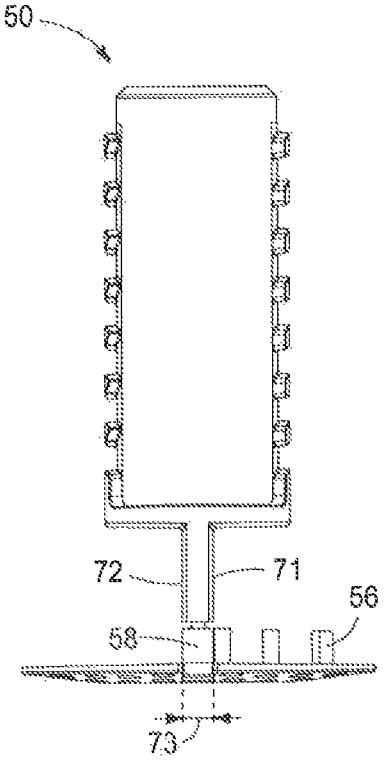
FIG. 20 is an orthographic side view of the spacer post and base member of FIG. 19, showing the axial slide channel.
Figure 21:
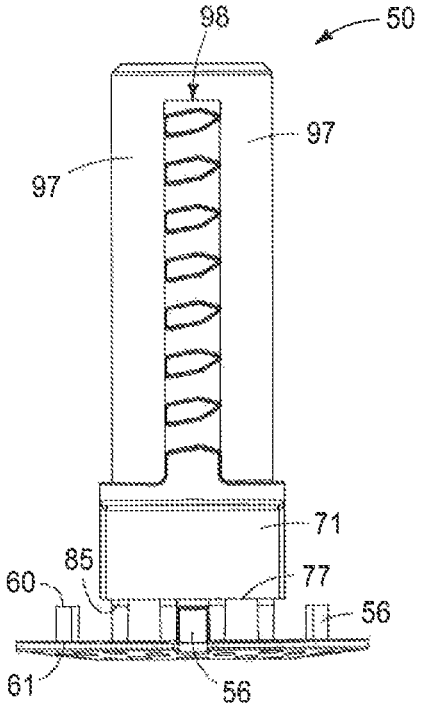
FIG. 21 is an orthographic side view of the spacer post and base member of FIG. 20, rotated axially 90° to show the plurality of vertically aligned and vertically spaced apart partial threads.
Figure 22:
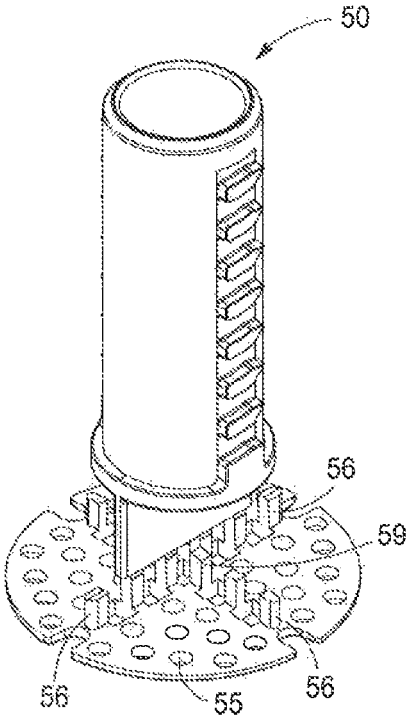
FIG. 22 is a perspective top and side view of the spacer post and base member, the base member having the four corner configuration of the plurality of predetermined surface features, and the plurality of surface features having a different thickness dimension.
Figure 23:
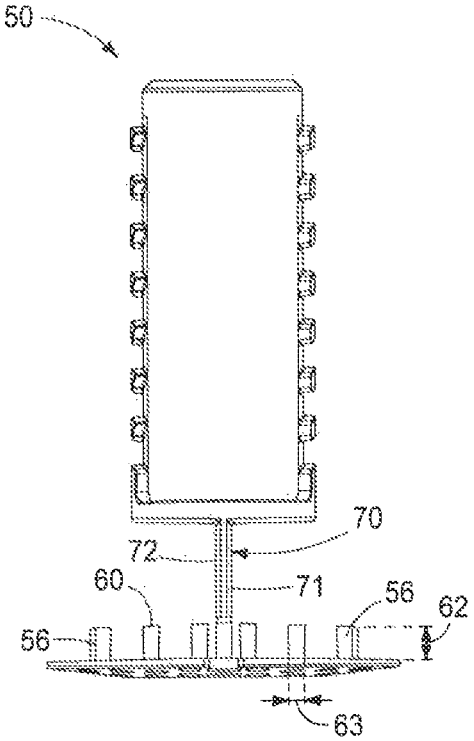
FIG. 23 is an orthographic side view of the spacer post and base member of FIG. 22.
Figure 24:
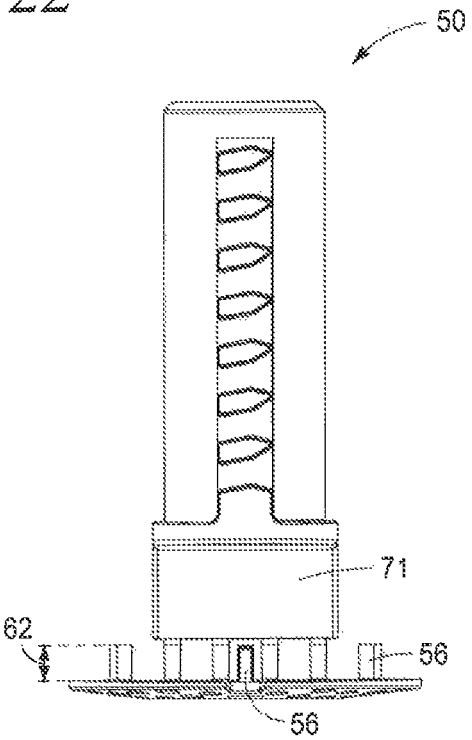
FIG. 24 is an orthographic side view of the spacer post and base member of FIG. 23, rotated axially 90°.

The base member 51 is generally planar, and may be disk shaped, and has a top surface 52, a bottom surface 53, a peripheral edge 54 extending thereabout, and a plurality of spacedly arrayed through holes 55 are defined in the base member 51 and communicate between the top surface 52 and the bottom surface 53. A plurality of predetermined surface features 56 are carried on the top surface 52 and extend generally vertically upwardly therefrom. Each of the plural predetermined surface features 56 has a top end portion 60, and a predetermined height dimension 62 between the top end portion 60 and the top surface 52 of the base member 51. Each of the plurality of surface features 56 further has a predetermined a thickness dimension 63, and a predetermined width dimension 64. The predetermined height dimension 62, the predetermined thickness dimension 63, and the predetermined width dimension 64 may all be varied/altered as desired to provide a desired spacing 308 between adjacent tiles 300, and to accommodate differing thicknesses of tiles 300. Each of the plurality of surface features 56 still further has a predetermined position relative to the others of the plurality predetermined surface features 56, so that the plurality of surface features 56 are spacedly arrayed in a predetermined pattern, on the top surface 52 of the base member 51. (E.g. four corner configuration 59, FIG. 13; linear configuration 57, FIG. 16; "T" configuration 58, FIG. 19). These three described configurations are shown as examples only, and are not limiting. Other predetermined configurations are likewise contemplated herein.

The shaft 90 is integral with the base member 51 and is generally cylindrical and elongate. The shaft 90 has a top end portion 92, a bottom end portion 93, an exterior circumferential surface 91, a diameter 95 and defines a longitudinal axis 94. The exterior circumferential surface 91 defines a plurality of predetermined and spacedly arrayed surface features 96, that are spacedly arrayed, in predetermined positions, between the top end portion 92 and the bottom end portion 93 and on the circumferential surface 91. The plurality of predetermined and spacedly arrayed surface features 96 include at least one grouping of a plurality of vertically aligned and vertically spaced apart partial threads 98. In one preferred embodiment, the exterior circumferential surface 91 defines two circumferentially spaced apart groupings of a plurality of vertically aligned and vertically spaced apart partial threads 98. (FIG. 14). Additional groupings of a plurality of partial threads 98, in excess of two groupings, are similarly contemplated herein.

Best shown in FIG. 15, each individual partial thread 98 has a beveled first end portion 101, a second end portion 102, a top surface 103, a bottom surface 104, a predetermined slope 105 relative to the longitudinal axis 94, and a thickness dimension 106. At least one axial slide channel 97, and preferably two circumferentially spaced apart axial slide channels 97 (plural axial slide channels 97), are defined on the exterior circumferential surface 91 of the shaft 90. The axial slide channel 97 is adjacent to the beveled first end portion 102 of each partial thread 98. In the contemplated configuration where there are two/plural axial slide channels 97, each of the two axial slide channels 97 space apart the two/plural groupings of the plurality of partial threads 98 from one another.

The breakaway connection 85 is between a bottom end portion 93 of the shaft 90 and the top end portion 60 of plural predetermined surface features 56 of the base member 51. The breakaway connection 85 provides a predetermined and intentional fracture location where the shaft 90 is separable from the base member 51.

Figure 25:
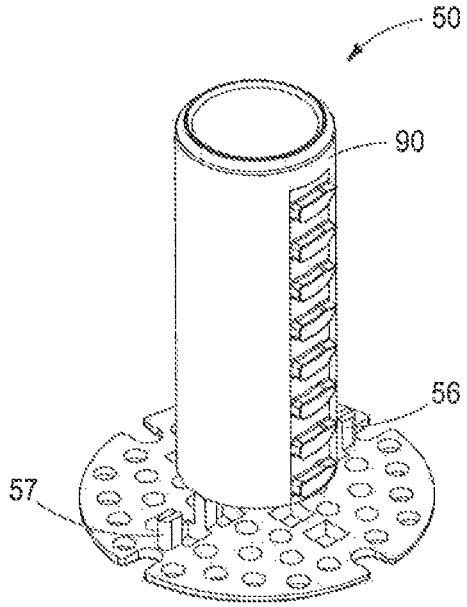
FIG. 25 is a perspective top and side view of the spacer post and base member, the base member having a linear configuration of the plurality of predetermined surface features, showing the spacer post shaft connected directly to plural elements of the plurality of predetermined surface features.
Figure 26:
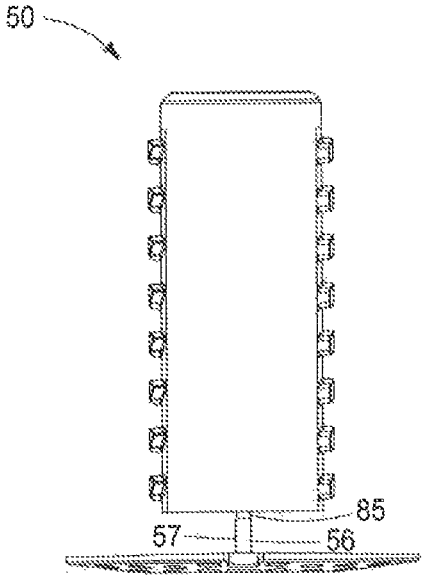
FIG. 26 is an orthographic side view of the spacer post and base member of FIG. 25, showing the axial slide channel.
Figure 27:
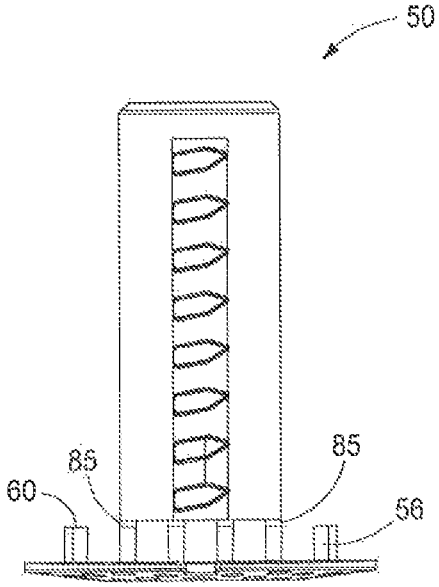
FIG. 27 is an orthographic side view of the spacer post and base member of FIG. 25, rotated axially 90° to show the plurality of vertically aligned and vertically spaced apart partial threads.
Figure 28:
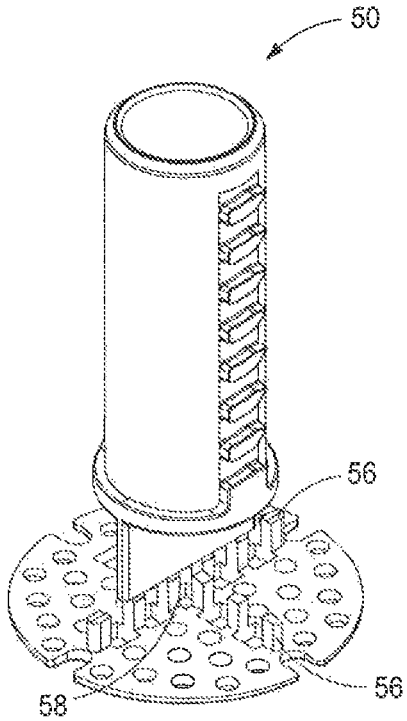
FIG. 28 is a perspective top and side view of the spacer post, and base pad, the base pad having the "T" configuration of the plurality of predetermined surface features, and the plurality of surface features having a different thickness and height dimension.
Figure 29:
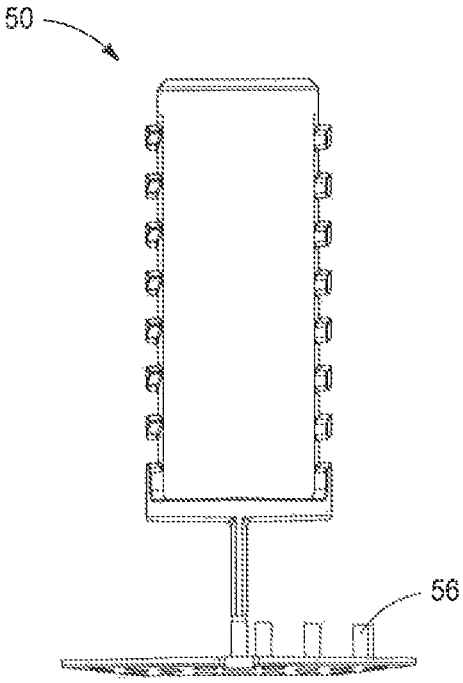
FIG. 29 is an orthographic side view of the spacer post and base member of FIG. 28.
Figure 30:
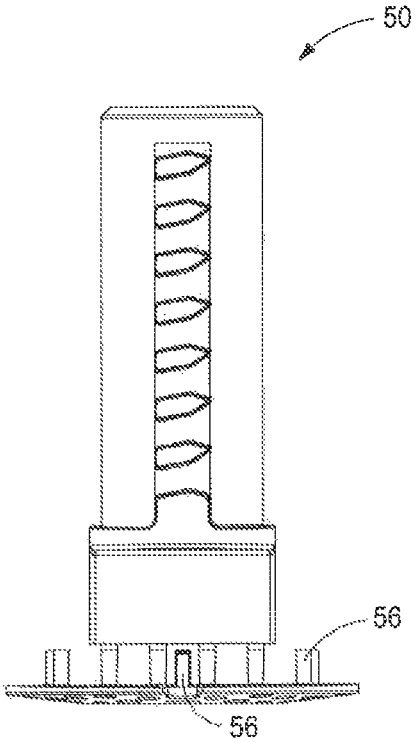
FIG. 30 is an orthographic side view of the spacer post and a base member of FIG. 28, rotated axially 90°.
Figure 31:
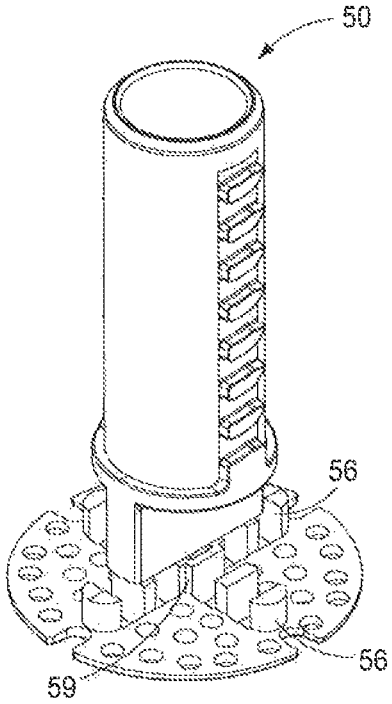
FIG. 31 is a perspective top and side view of the spacer post, and base member, the base member having the four corner configuration of the plurality of predetermined surface features, and the plurality of predetermined surface features having a different thickness and height dimension.
Figure 32:
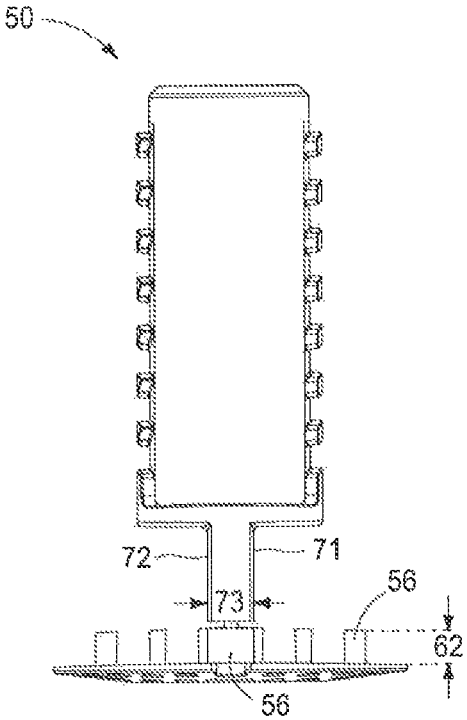
FIG. 32 is an orthographic side view of the spacer post and base member of FIG. 31.
Figure 33:
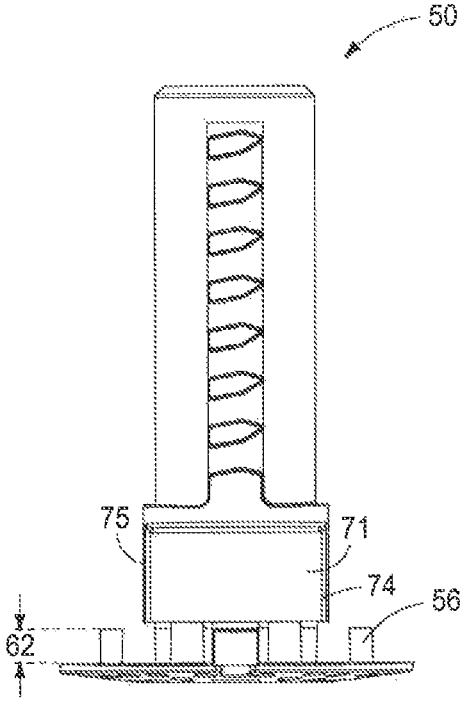
FIG. 33 is an orthographic side view of the spacer post and a base member of FIG. 31, rotated axially 90°.
Figure 34:
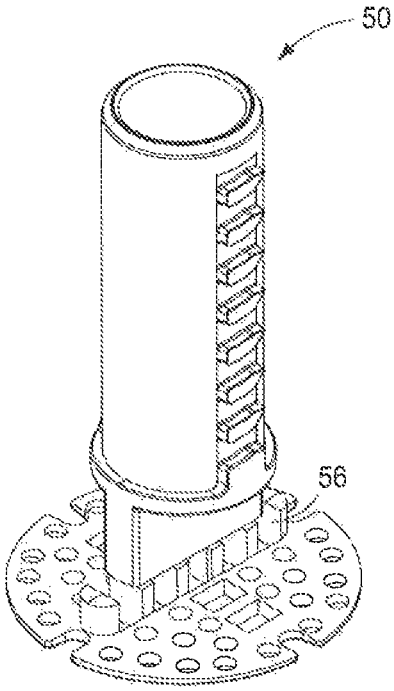
FIG. 34 is a perspective top and side view of the spacer post, and base member, the base member having the linear configuration of the plurality of predetermined surface features, and the plurality of predetermined surface features having a different thickness and height dimension.
Figure 35:
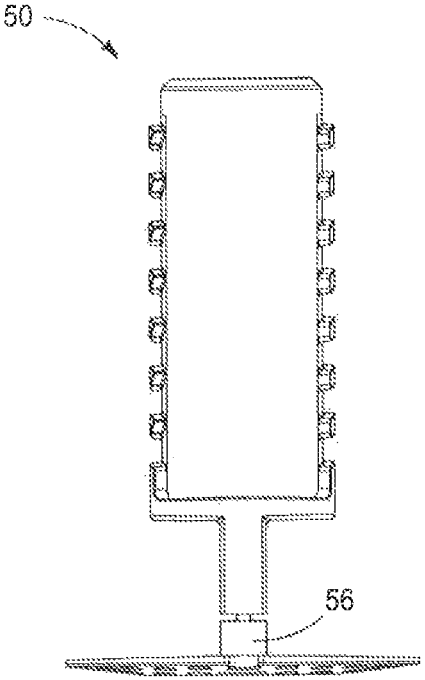
FIG. 35 is an orthographic side view of the spacer post and base member of FIG. 34.
Figure 36:
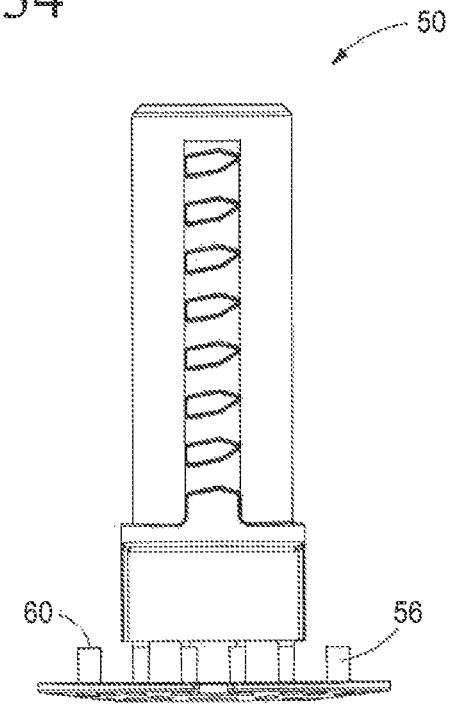
FIG. 36 is an orthographic side view of the spacer post and a base member of FIG. 34, rotated axially 90°.
Figure 37:
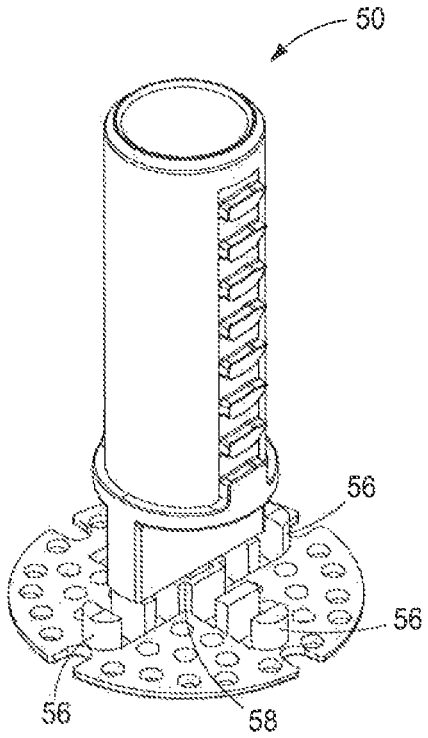
FIG. 37 is a perspective top and side view of the spacer post, and base pad, the base pad having the configuration of the plurality of predetermined surface features, and the plurality of predetermined surface features having a different thickness and height dimension.
Figure 38:
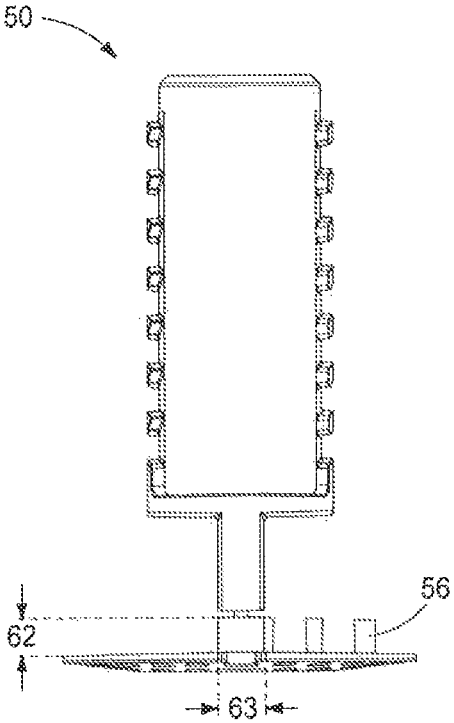
FIG. 38 is an orthographic side view of the spacer post and base member of FIG. 37.
Figure 39:
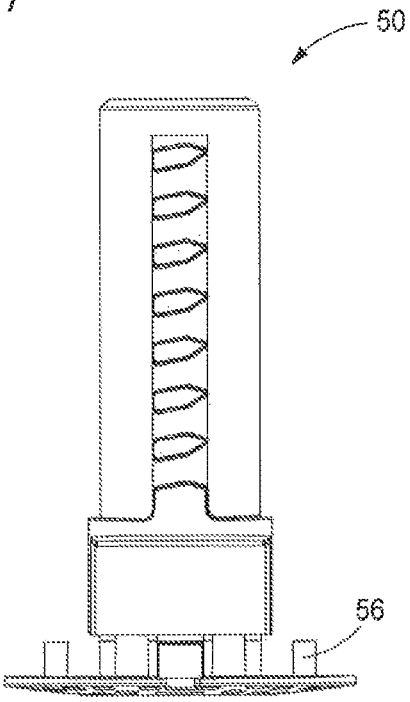
FIG. 39 is an orthographic side view of the spacer post and a base member of FIG. 37, rotated axially 90°.
Figure 40:
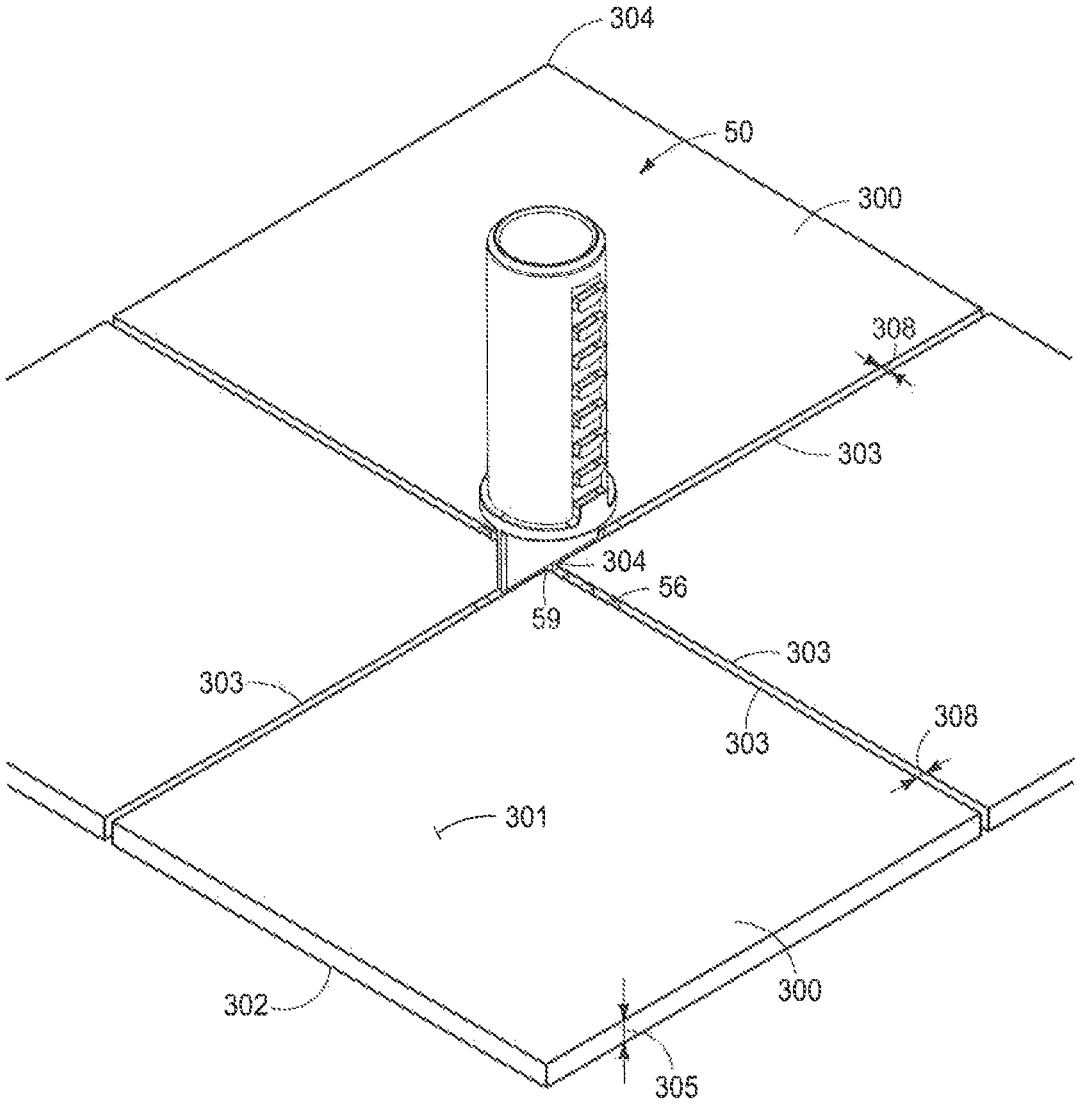
FIG. 40 is a perspective top and side view of a spacer post positioned at the intersection of four corners of adjacent tiles, with the base member under the tiles and the plurality of predetermined surface features providing the predetermined spacing between the four adjacent tiles.
Figure 41:
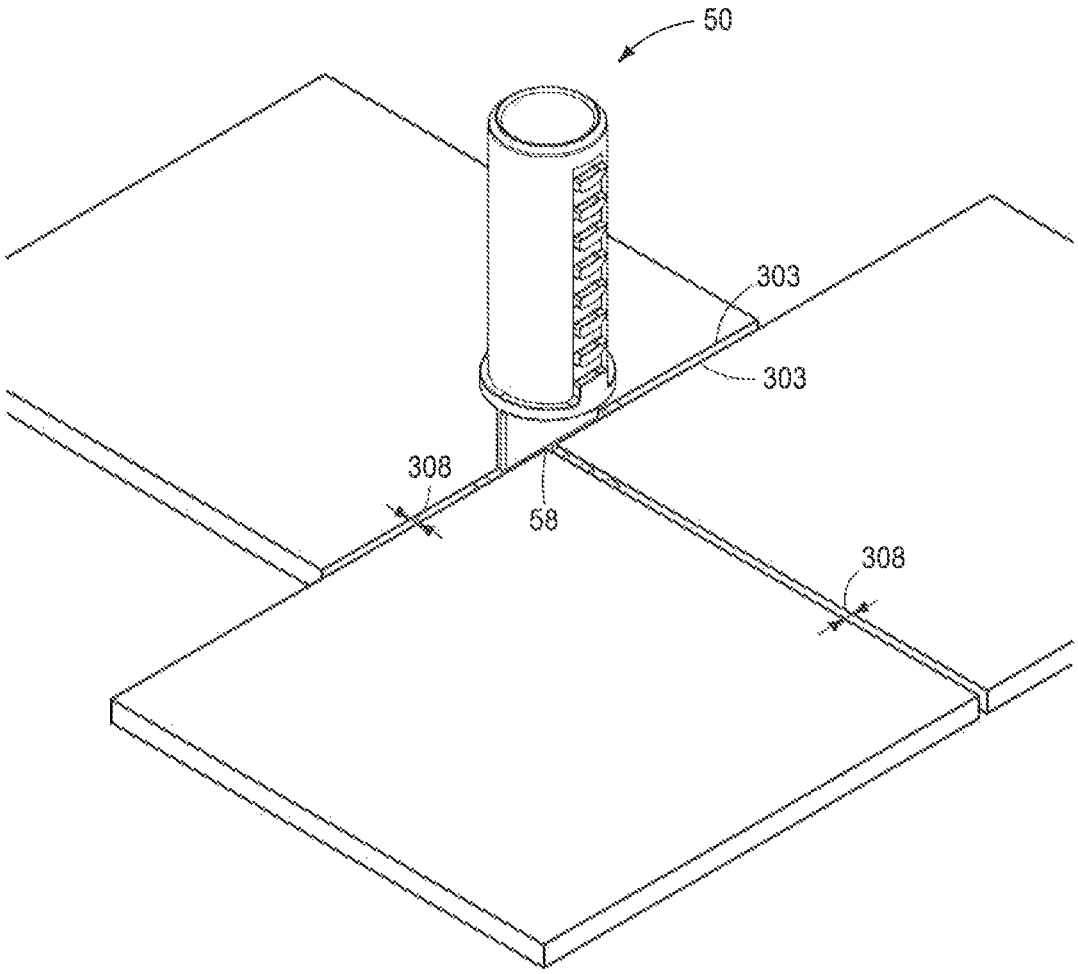
FIG. 41 is a perspective top and side view of a spacer post positioned at the intersection of three adjacent tiles, with the base member under the tiles and the plurality of predetermined surface features providing the predetermined spacing between the three adjacent tiles.
Figure 42:
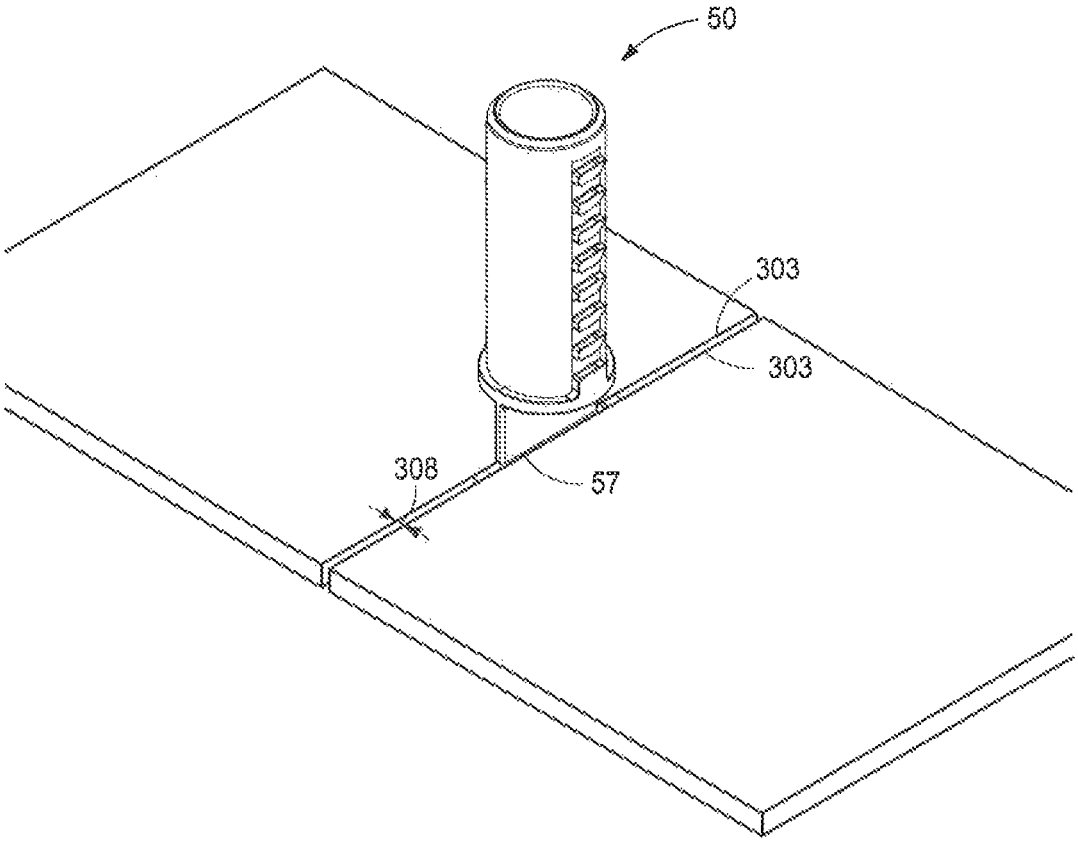
FIG. 42 is a perspective top and side view of a spacer post positioned at a joint between two adjacent tiles, with the base member under the files and the plurality of predetermined surface features providing the predetermined spacing between the two adjacent tiles.
Figure 43:
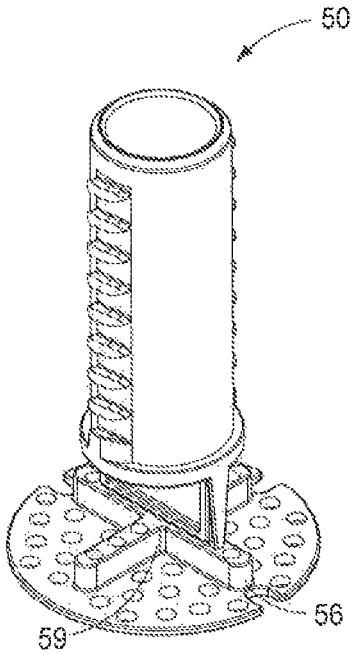
FIG. 43 is a perspective top and side view of the spacer post, and base member showing another contemplated configuration of plurality of predetermined surface features on the base member.
Figure 44:
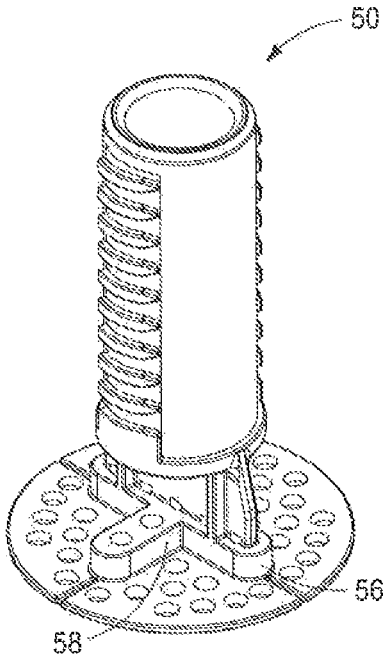
FIG. 44 is a perspective top and side view of the spacer post, and base member showing another contemplated configuration of the plurality of partial threads on the spacer post, and another contemplated configuration of the plurality of predetermined surface features on the base member.
Figure 45:
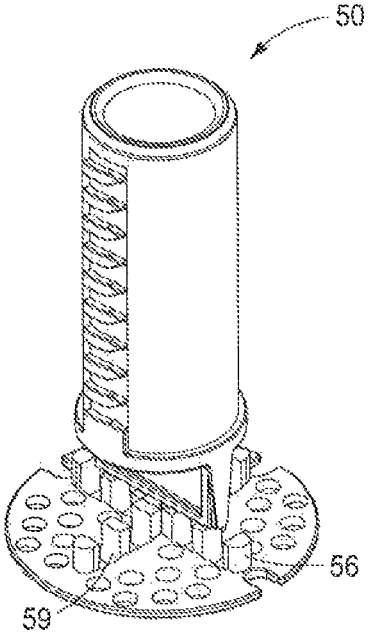
FIG. 45 is a perspective top and side view of the spacer post, and base member showing another contemplated configuration of plurality of predetermined surface features on the base member.
Figure 46:
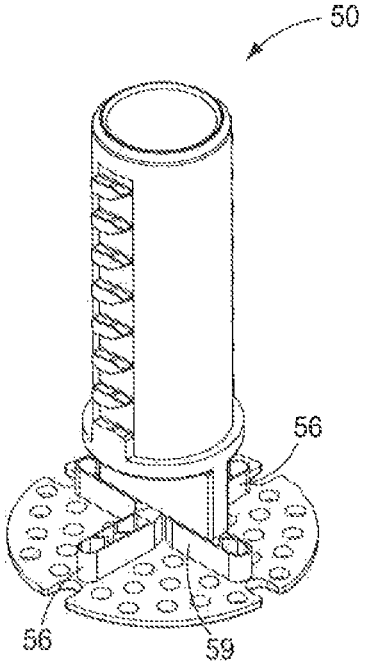
FIG. 46 is a perspective top and side view of the spacer post, and base member showing another contemplated configuration of plurality of predetermined surface features on the base member.

In one preferred embodiment (FIGS. 13-15) a spacer 70 may be carried between the bottom end portion 93 of the shaft 90, and the breakaway connection 85. In this contemplated embodiment, the spacer 70 can assist in accurately maintaining spacing 308 between adjacent tiles 300 (FIGS. 40-42) and provides a height dimension for the leveler 120. In another preferred embodiment (FIGS. 25-27) the breakaway connector 85 is immediately between the bottom end portion 93 of the shaft 90 and the top end portions 60 of the plural predetermined surface features 56.

Figure 10:
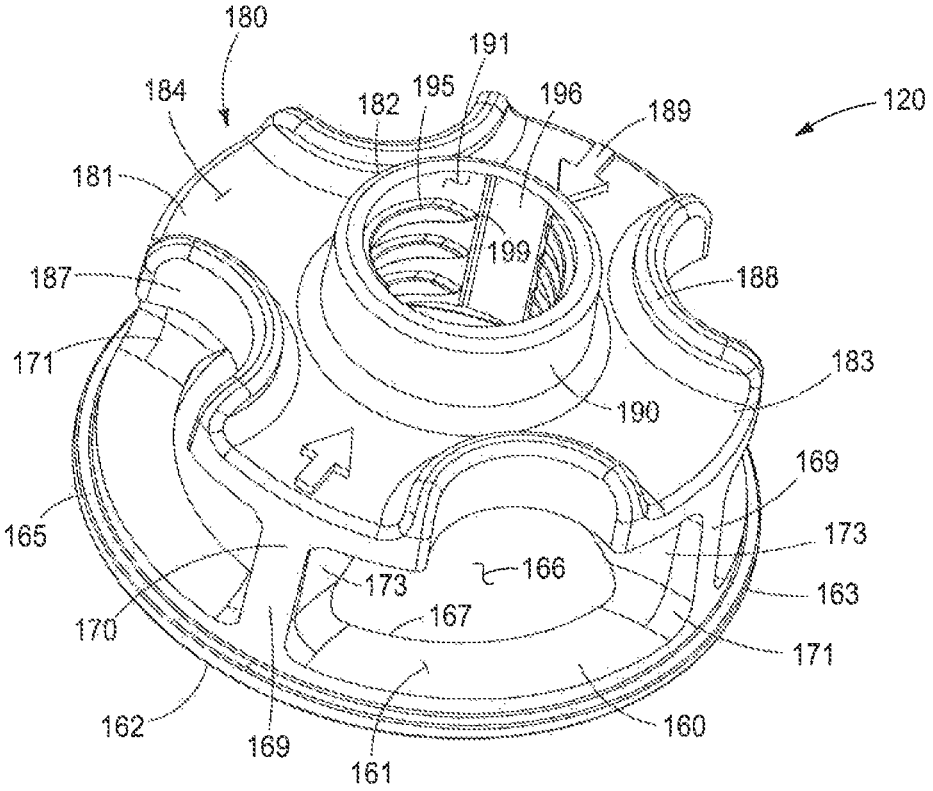
FIG. 10 is a perspective top and side view of the leveler.
Figure 11:
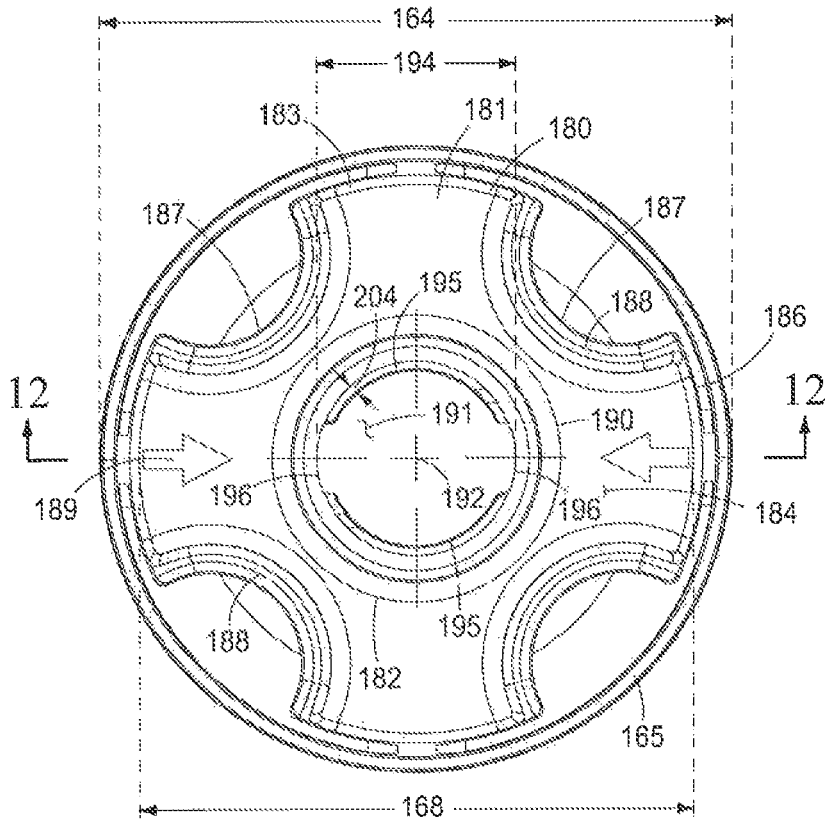
FIG. 11 is a top plan view of the leveler of FIG. 10.
Figure 12:
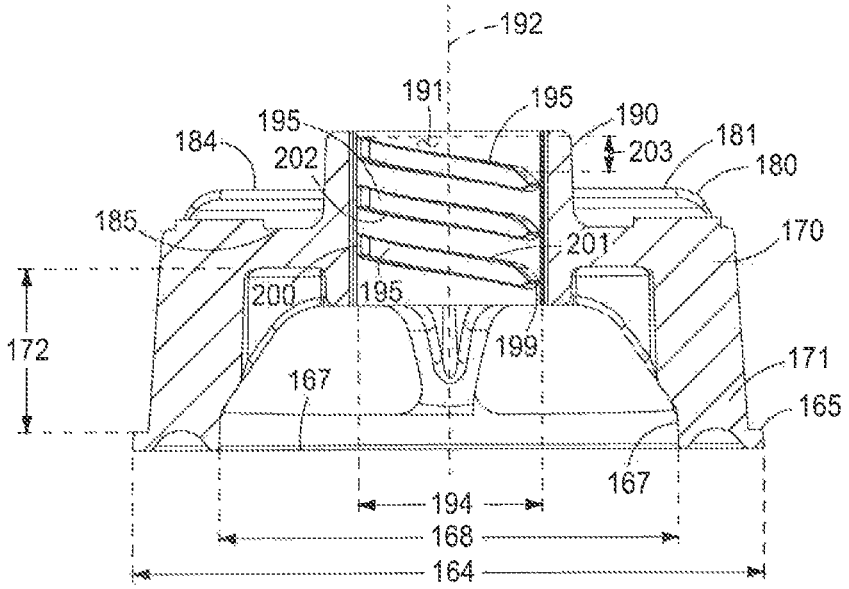
FIG. 12 is an orthographic cross section view of the leveler, taken on line 12-12 of FIG. 11.

The leveler 120 (FIG. 10) is axially slidably, and rotatably threadably, engageable with the spacer post 50, and the leveler 120 generally provides a friction plate 130, a foot ring 160 and an engager 180.

The friction plate 130 (FIGS. 6-9) is generally annular in configuration and has a top surface 131, a bottom surface 132, and an outer circumferential edge 134 defining an outer diameter 136. The friction plate 130 further defines a medial hole 147 that has an inner circumferential edge 133 that defines an inner diameter 148, and an axis 146. An O-ring groove 137 is defined in the bottom surface 132 of the friction plate 130 to releasably carry an O-ring 138 therein. An annular slide track 139 is defined in the top surface 131 for axial rotational slidable engagement with the foot ring 160. The annular slide track 139 has an outer circumferential edge 140 and an inner circumferential edge 141. The friction plate 130 further has a rounded bottom corner 142 at the outer circumferential edge 134, and a retaining lip 145 at the outer circumferential edge 134 adjacent to the top surface 131. The retaining lip 145 maintains the foot ring 160 in axially rotational slidable engagement with the slide track 139. An upwardly extending annularly shaped convex protrusion 143 is defined in the annular slide track 139 and is due to the O-ring groove 137 defined in the bottom surface 132. The O-ring 198 enhances friction between the friction plate 130 and the top/exposed surface 301 of the ceramic tile 300 that is positioned immediately thereunder. The enhanced friction, generated by the O-ring 198 prevents the friction ring 130 from rotating axially upon the top/exposed surface 301 of the ceramic tile 300 responsive to rotation of the leveler 120 which may cause the damage to the ceramic tile 300, such as by scuffing or otherwise marring the top surface 301. Further still, the enhanced surface friction provided by the O-ring 198 prevents the ceramic tiles 300 from tending to move/change position responsive to any lateral forces exerted thereon responsive to the tightening/rotation of the leveler 120 upon the shaft 90.

The foot ring 160 is annular and has a top surface 161 and a bottom surface 162 that frictionally slidably communicates within the annular slide track 139 of the friction plate 130. Although not shown in the drawings, the bottom surface 162 of the foot ring 160 defines a concave groove to accommodate the convex protrusion 143 within the annular slide track 139 of the friction plate 130. The foot ring 160 further has an outer circumferential edge 163 that defines an outer diameter 164 having a retaining lip portion 165, a medial hole 166 having an inner circumferential edge 167 that defines an inner diameter 168, and an axis 192. Plural spaced apart engager legs 169 are structurally carried on the top surface 161, and each of the plural spaced apart engager legs 169 has a bottom end portion 171 interconnected with the top surface 161 of the foot ring 160, and each has a top end portion 170, opposing lateral side portions 173, and a predetermined height dimension 172 between the top end portion 170 and the bottom end portion 171. The foot ring 160 is slidably and rotatably carried within the annular slide track 139 of the friction plate 130 so that the foot ring 160, and the friction plate 130 are independently rotatable relative to one another.

The retaining lip 145 is shown, in the drawings, as adjacent the outer circumferential edge 140 of the friction plate 130, it is contemplated however that a retaining lip 145 may likewise be carried at the inner circumferential surface 141 of the annular slide track 139 so as to provide the same function of securing the foot ring 160 within the annular slide track 139.

The engager 180 has a body 181 that is somewhat disc shaped, and is structurally interconnected with the top end portion 170 of each of the plural spaced apart engager legs 169. The body 181 has a top surface 184, a bottom surface 185, a medial cylindrical portion 182, and an outer circumferential edge 186 that defines gripping features 187 to enhance gripping by a user. Each of the gripping features 187 has a dimensionally thickened outer edge portion 188, and the medial cylindrical portion 182 has a barrel portion 190 that defines a medial channel 191 that extends therethrough and defines an axis 192 and has an interior diameter 194. The barrel portion 190 further has an outer circumferential surface 208 and an inner circumferential surface 209 within the medial channel 191. The inner circumferential surface 209 defines a plurality of predetermined and spacedly arrayed surface features, and the plurality of predetermined and spacedly arrayed surface features include at least one grouping of a plurality of vertically aligned and vertically spaced apart, partial threads 195. In a further contemplated embodiment, there are two circumferentially spaced apart groupings, each grouping having a plurality of vertically aligned and vertically spaced apart, partial threads 195. Each individual partial thread 195 has a beveled first end portion 199, a second end portion 200, a top surface 201, a bottom surface 202, a thickness 204 and a predetermined slope 203 relative to the axis 192 of the medial channel 191. At least one axial slide channel 196, and preferably two axial slide channels 196, are defined in the inner circumferential surface 209 of the medial channel 191, and the two axial slide channels 196 are circumferentially spaced apart from one another. An alignment indicator 189 (an arrow) is defined on the top surface 184 of the body 181 and the alignment indicator 189 identifies the location of the predetermined surface features within the medial channel 191.

The interior diameter 194 of the medial channel 191 defined by the leveler 120 is slightly larger than the diameter 95 of the shaft 90 so that the leveler 120 is both axially slidably, and rotatably threadably, engageable with the spacer post 50 shaft 90. The thickness 106 of the plurality of partial threads 98 carried on the exterior circumferential surface 91 of the shaft 90, is slidably accommodated within the axial slide channel 196. Vertical spacing between vertically adjacent partial threads 98, 195 on the shaft 90, and within the medial channel 191 respectively, is substantially the same so that axial rotation of the leveler 120 about to the shaft 90 causes the partial threads 98, 195 to threadably engage with one another. The slope 105, 203 of each partial thread, respectively, causes the leveler 120 to move axially relative to the spacer post 50 responsive to axial rotation of the engager body 181. Due to the configuration, location and size and slope of the plurality of partial threads 98, 195 only a partial rotation of the engager body 181 is necessary to generate the desired axial movement of the leveler 120 relative to the spacer post 50.

As can be seen in the drawings, axial rotation of the engager 180 responsively axially rotates the foot ring 150, but does not necessarily rotate the friction plate 130 which is independently movable relative to the foot ring 150, and may remain stationary upon the tiles 300.

In a further contemplated embodiment, not shown in the drawings, the shaft 90 of the base member 50 may define a plurality of spacedly arrayed partial slots in the exterior circumferential surface 91 of the shaft 90. The spacedly arrayed partial slots, (Not shown) which have a slope 105 relative to the axis 94 of the shaft 90 function/perform similarly to the plurality of partial threads 98 by providing a "slot" that engage with the plurality of partial threads 195 carried on the inner circumferential surface 209 of the engager 180 barrel portion 190, Even further still, it is contemplated that the plurality of partial threads 98 may be defined on an interior surface of a medial channel defined by the shaft 90. Such plurality of partial threads 98 defined on the interior surface of the medial channel defined by the shaft 90 would engage with a plurality of partial threads defined on an exterior surface of a coaxially aligned rod carried by the leveler 120 which would be axially inserted into the medial channel.

Having described the structure of my tile lippage control and tile spacing system, and method therefore, its operation will be briefly described.

Operation

The operation of the described embodiment of the present invention is believed to be readily apparent, and is briefly summarized at this point.

In its broadest aspect the present invention relates to a lippage control and tile spacing system, and method therefore.

More specifically, the present invention relates to a device, system and method for controlling (minimizing) tile lippage during tile installation, and also for controlling spacing between adjacent tiles during installation.

The present inventive method for controlling tile lippage and controlling tile spacing in setting tiles in a substrate, comprises the following steps.

Providing a surface that is at least partially covered with a substrate 306, the surface may be, but is not limited to, a generally horizontal surface, such as a floor or countertop, or a generally vertical surface, such as a shower wall, kitchen backsplash or a vertical wall surface of a building, or nearly any other surface.

Providing at least two tiles 300 to be placed adjacent one another in the substrate 306 with a predetermined distance 308 between adjacent edge portions of the at least two tiles 300.

Providing a spacer post 50 having a base member 51, a shaft 90, and a breakaway connection 85 between the shaft 90 and the base member 51.

The base member 51 is generally planar and has a top surface 52, a bottom surface 53, a peripheral edge 54 extending thereabout, and a plurality of spacedly arrayed through holes 55 are defined in the base member 51 and communicate between the top surface 52 and the bottom surface 53, and plural predetermined surface features 56 are carried on the top surface 52 and extend generally vertically upwardly therefrom. Each of the plural predetermined surface features 56 having a top end portion 60, a predetermined height dimension 62, a predetermined a thickness dimension 63, a predetermined width dimension 64, and a predetermined position relative to the others of the predetermined surface features 56.

The breakaway connection 85 is between the bottom end portion 93 of the shaft 90 and the base member 51. The breakaway connection 85 provides a predetermined and intentional fracture location where the shaft 90 is separable from the base member 51.

The shaft 90 is generally cylindrical and elongate and has a top end portion 92, a bottom end portion 93, an exterior circumferential surface 91, a diameter 95 and defines a longitudinal axis 94. A plurality of predetermined and spacedly arrayed surface features 96 are defined on the exterior circumferential surface 91 between the top end portion 92 and the bottom end portion 93. The plurality of predetermined and spacedly arrayed surface features 96 include a plurality of vertically aligned and vertically spaced apart partial threads 98, each of the partial threads 98 having a beveled first end portion 101 and a second end portion 102, a top surface 103, a bottom surface 104 and a predetermined slope 105 relative to the longitudinal axis 94. An axial slide channel 97 is defined on the exterior circumferential surface 91 of the shaft 90, and the axial slide channel 97 is adjacent the first end portion 101 of the plurality of partial threads 98.

The first tile 300 is placed, in a predetermined position, within the substrate 306.

The base member 51 of the spacer post 50 is placed within the substrate 306 and a portion of the generally planar base member 51 is positioned under one edge of the placed first tile 300 so that some amount of substrate 306 flows into and through the plurality of spacedly arrayed through holes 55 defined in the generally planar base portion 51, and an edge portion of the placed first tile 300 is in direct frictional contact with at least some of the plurality of predetermined surface features 56 carried on the top surface 52 of the generally planar base portion 51, and the shaft 90 is positioned so that it extends generally perpendicular to an exterior surface of the first placed tile 300 and adjacent the edge of the first placed tile 300.

A second tile 300 is placed in the substrate 306 immediately adjacent the plurality of predetermined surface features 56 carried on the top surface 52 of the generally planar base portion 51 of the base member 50 that was previously placed in the substrate, and at least partially underneath the edge of the first placed tile 300. The second tile 300 is aligned immediately adjacent, and frictionally against, the predetermined surface features 56 so that the predetermined thickness dimension 63 of each of the predetermined surface features 56 provides spacing between the first and second placed tiles 300, and so that the shaft 90 extends outwardly from the space between the first and second placed tiles 300. In the event the "T" configuration 58 of predetermined surface features 56 is used, (FIG. 19), a third tile 300 is positioned frictionally against the predetermined surface features 56 so that the shaft 90 extends outwardly from the three corner intersection. Further still, in the event the four corner configuration 59 of predetermined surface features 56 is used, (FIG. 13) a third and a fourth tile 300 are positioned frictionally against the predetermined surface features 56 so that the shaft 90 extends outwardly from the four corner intersection.

A leveler 120 is provided to releasably and adjustably engage with the spacer post shaft 90, the leveler 120 having a friction plate 130, a foot ring 160 and an engager 180.

The friction plate 130 is annular and has a top surface 131, a bottom surface 132, an outer circumferential edge 134 defining an outer diameter 136, a medial hole 147 having an inner circumferential edge 133 defining an inner diameter 148, and an axis 146. An O-ring groove 137 is defined in the bottom surface 132 to releasably carry a friction enhancing and scuff resistant O-ring 138 therein. An annular slide track 139 is defined in the top surface 131 for slidable engagement with the foot ring 160, the annular slide track 139 has a radially extending retaining lip 145 at a circumferential edge 133, 134 to maintain the foot ring 160 in axially rotational slidable engagement with the slide track 139.

The foot ring 160 is annular and has a top surface 161, a bottom surface 162 that frictionally slidably communicates with the slide track 139 of the friction plate 130, an outer circumferential edge 163 defining an outer diameter 164 having a lip 165, a medial hole 166 having an inner circumferential edge 167 defining an inner diameter 168, and an axis 192, and plural spaced apart engager legs 169 are structurally carried on the top surface 161, and each of the plural spaced apart engager legs 169 has a bottom end portion 171 interconnected with the top surface 161 of the foot ring 160, and a top end portion 170, opposing lateral side portions 173 and a predetermined height dimension 172 between the top end portion 170 and the bottom end portion 171.

The engager 180 has a body 181 and the body 181 is structurally interconnected with the top end portion 170 of each of the plural spaced apart engager legs 169, and the body 181 has a top surface 184, a bottom surface 185, a medial cylindrical portion 182 and an outer circumferential edge 186 that defines gripping features 187 to enhance gripping by a user. Each of the spaced apart gripping features 187 has a dimensionally thickened outer edge portion 188, and medial cylindrical portion 182 has a barrel portion 190 that defines a medial channel 191 having an axis 192, and that has an interior diameter 194, and the barrel portion 190 has an outer circumferential surface 208 and an inner circumferential surface 209 within the medial channel 191, and the inner circumferential surface 209 defines a plurality of predetermined and spacedly arrayed surface features 193, and the plurality of predetermined and spacedly arrayed surface features 193 include a plurality of vertically aligned and vertically spaced apart, partial threads 195, each partial thread 195 having a beveled first end portion 199 and a second end portion 200, a top surface 201, a bottom surface 202, a predetermined thickness 204 and a predetermined slope 203 relative to the axis 192 of the medial channel 191. An axial slide channel 196 is defined in the interior circumferential surface 209 of the medial channel 191, and the axial slide channel 196 is adjacent the beveled first end portion 199 of the plurality of partial threads 195, and an alignment indicator 189 184 is defined on the top surface of the body 181 and the alignment indicator 189 identifies the location of the predetermined surface features 193 within the medial channel 191.

The leveler 120 is positioned and oriented adjacent above the top end portion 92 of the spacer post 50 shaft 90 so that the leveler axis 192 is coaxially aligned with the shaft longitudinal axis 94 and so that the plurality of vertically aligned and vertically spaced apart partial threads 98 defined on the shaft 90 are vertically axially aligned with the axial slide channel 196 defined in the interior circumferential surface 209 of the engager 180. The leveler 120 is axially slidably engaged onto the spacer post 50 shaft 90, and moved slidably axially there along the spacer post shaft 90 until the O-ring 138 carried on the bottom surface 132 of the friction plate 130 frictionally contacts the top surface of the plural previously placed tiles 300.

The engager 180 is axially rotated about the spacer post shaft 90 a partial turn (less than one full rotation) so that the plurality of vertically aligned and vertically spaced apart partial threads 98 defined on the shaft 90 threadably engage with the plurality of vertically aligned and vertically spaced apart partial threads 195 defined on the interior circumferential surface 209 of the medial channel 191 of the engager 180. Axial rotation of the engager 180 responsively causes the foot ring 162 axially rotate within the slide track 139 defined in the top surface 131 of the friction plate 130, while the friction plate 130 remains stationary on the plural previously placed tiles 300 so as to not mar/scuff/damage the tiles, and further so that the axial rotational movement of the engager 180 does not transfer any component of lateral movement to the files 300 which might cause the tiles 300 to shift their position within the substrate 306 and/or relative to the plurality of predetermined surface features 56 of the base member 51. Responsive to axial rotation of the engager 180, the leveler 120, the foot ring 160 and friction plate 130 are moved axially along the spacer post shaft 90 into closer proximity to the base member 51 with the plural previously placed tiles 300 therebetween, responsively reducing lippage between the plural previously placed tiles 300 while maintaining spacing between the plural previously placed tiles 300. The plurality of partial threads 98, 195, which are separated by the axial slide channels 99, 196 provide that the leveler 120 need be axially rotated less than one full rotation, relative to the spacer post shaft 90, to provide the resulting axial movement therebetween.

An amount of time is allowed to pass so that the substrate hardens/cures so as to positionally secure the plural previously placed tiles 300 in the substrate 306.

After the substrate 306 has hardened, and the plural previously placed tiles 300 are positionally secured therein, the user intentionally strikes an oblique blow to the leveler 120 and spacer post shaft 90 with a blow sufficient to cause the spacer post shaft 90 to separate from the base member 51 at the break-away connection 85 between the shaft 90 and the base member 51. The fracturing of the breakaway connection 85 permanently leaves the generally planar base member 51 within the hardened/cured substrate 306 and at least partially below/underneath the plural previously placed tiles 300.

If desired, a user may remove the leveler 120 from the shaft 90 prior to striking the fracturing blow, but such removal is not required an adds an unneeded step in the process.

Grout (not shown) is thereafter placed within the spaces between the plural previously placed tiles 300 to fill the space and cover the portion of the breakaway connection remaining between the plural previously placed tiles 300.

The separated shaft 90 is removed from the leveler 120 by axially rotating the shaft 90 so that the plurality of partial threads 98 carried on the shaft 90 axially align with the axial slide channel 196 defined in the inner circumferential surface 209 of the engager body 181. The separated shaft 90 may thereafter be axially withdrawn from the engager body 181. Following disengagement of the separated shaft 90, the leveler 120 may be reused as desired.

Therefore, it will be seen that the present invention provides a convenient means for avoiding the shortcomings attendant with the prior art tile lippage control and tile spacing devices and systems and methods which have been used, heretofore, in the installation of tiles in the past. The present invention is easy to use, provides consistently uniform results, does not require removal of the tile spacers, and minimizes installation time, and is partially reusable again and again.

In compliance with the statute, my invention has been described in language more or less specific as to structural and methodical features. It is to be understood, however, that the invention is not limited to specific features shown and described since the means herein disclosed comprise preferred forms of putting the invention into effect. The invention is therefore claimed, in any of its forms or modifications, within the proper scope of the appended claims appropriately interpreted in accordance with the doctrine of equivalence.

I claim:

1. A tile lippage control and tile spacing system comprising:

a spacer post having a base member, a shaft, and a breakaway connection between the base member and the shaft; and a leveler that releasably and adjustably engages with the spacer post shaft, the leveler having a friction plate, a foot ring and an engager; and the leveler is separately axially slidably movable along an axial length of the spacer post shaft without axial rotation of the leveler relative to the spacer post shaft; and the leveler is separately rotatably threadably engageable with the spacer post shaft along the axial length of the spacer post shaft by axial rotation of the leveler relative to the spacer post shaft; and wherein the base member is generally planar and has a top surface, a bottom surface, a peripheral edge extending thereabout, and a plurality of spacedly arrayed through holes are defined in the base member and communicate between the top surface and the bottom surface, and plural predetermined surface features are carried on the top surface and extend generally vertically upwardly therefrom, and each of the plural predetermined surface features have a top end portion, a predetermined height dimension, a predetermined a thickness dimension, and a predetermined position relative to the others of the plurality predetermined surface features; and wherein a spacer member between the baser member and the shaft, and the spacer member is generally planar and has a first side and a second side with a predetermined thickness dimension therebetween, a first lateral edge, a second lateral edge, a top end portion and a bottom end portion with a predetermined height dimension therebetween, and the top end portion is structurally interconnected to a bottom end portion of the shaft, and the bottom end portion of the spacer member is interconnected with the top end portions of plural predetermined surface features on the top surface of the base member; and wherein the breakaway connection is between the bottom end portion of the spacer member and the top end portion of plural predetermined surface features of the base member, and the breakaway connection provides a predetermined and intentional fracture location where the spacer member and shaft are separable from the base member.

2. A tile lippage control and tile spacing system comprising:

a spacer post having a base member, a shaft, and a breakaway connection between the base member and the shaft; and leveler that releasably and adjustably engages with the spacer post shaft, the leveler having a friction plate, a foot ring and an engager; and the leveler is separately axially slidably movable along an axial length of the spacer post shaft without axial rotation of the leveler relative to the spacer post shaft; and wherein the spacer post shaft is generally cylindrical and elongate and has a top end portion, a bottom end portion, an exterior circumferential surface, a diameter and defines a longitudinal axis, and the shaft is interconnected with the breakaway connection, and a plurality of predetermined and spacedly arrayed surface features are defined on the exterior circumferential surface of the shaft between the top end portion and the bottom end portion, and the plurality of predetermined and spacedly arrayed surface features include a plurality of vertically aligned and vertically spaced apart partial threads, each of the partial threads having a first end portion and a second end portion, a top surface, a bottom surface and a predetermined slope relative to the longitudinal axis, and the plurality of predetermined and spacedly arrayed surface features further include a vertical slide channel defined on the exterior circumferential surface of the shaft, and the vertical slide channel is adjacent to the first end portion of the plurality of partial threads.

3. The tile lippage control and tile spacing system of claim 2 and wherein, the shaft is generally cylindrical and elongate and has a top end portion, a bottom end portion, an exterior circumferential surface, a diameter and defines a longitudinal axis, and the shaft is interconnected with the breakaway connection at plural spacedly arrayed locations, and a plurality of predetermined and spacedly arrayed surface features are defined on the exterior circumferential surface of the shaft between the top end portion and the bottom end portion, and the plurality of predetermined and spacedly arrayed surface features include two circumferentially spaced apart groupings of a plurality of vertically aligned and vertically spaced apart partial threads, each of the partial threads having a first end portion and a second end portion, a top surface, a bottom surface and a predetermined slope relative to the longitudinal axis, and two circumferentially spaced apart axially aligned slide channels are defined on the exterior circumferential surface of the shaft, and each of the slide channels space apart the circumferentially spaced apart groupings of the plurality of partial threads from one another.

4. The tile lippage control and tile spacing system of claim 2 and wherein, the friction plate is annular and has a top surface, a bottom surface, an outer circumferential edge having an outer diameter, a medial hole having an inner circumferential edge defining an inner diameter, an axis, and an O-ring groove is defined in the bottom surface of the friction plate to carry an O-ring therein; and an annular slide track is defined in the top surface of the friction plate for rotational slidable engagement with the foot ring, and the annular slide track has a retaining lip at an edge portion to maintain the foot ring in axially rotational slidable engagement with the slide track.

5. The tile lippage control and tile spacing system of claim 2 and wherein, the engager has a body, that is interconnected with the foot ring, and the body has a top, a bottom, a medial cylindrical portion, an outer circumferential edge that defines gripping features to enhance gripping by a user, and the medial cylindrical portion has a barrel portion that has an outer circumferential surface and the barrel portion defines a medial channel that defines an axis, and the barrel portion has an inner circumferential surface and an inner diameter and the inner circumferential surface defines a plurality of predetermined and spacedly arrayed surface features, and the plurality of predetermined and spacedly arrayed surface features include a grouping of plural vertically aligned and vertically spaced apart, partial threads, each partial thread having a first end portion and a second end portion, a top surface, a bottom surface and a predetermined slope relative to the axis, and an axial slide channel is defined in the interior circumferential surface of the medial channel, and the axial slide channel is adjacent to the first end portion of the plural vertically aligned and vertically spaced apart partial threads, and an alignment indicator is defined on the top surface of the body and the alignment indicator identifies the location of the predetermined surface features within the medial channel.

6. The tile lippage control and tile spacing system of claim 5 and further comprising:

two spaced apart groupings of plural vertically aligned and vertically spaced apart partial threads.

7. The tile lippage control and tile spacing system of claim 6 and further comprising:

two spaced apart axial slide channels defined in the inner circumferential surface of the medial channel and each of the two spaced apart axial slide channels separates the two groupings of vertically aligned and vertically spaced apart, partial threads, from one another.

8. A tile lippage control and tile spacing system comprising:

a spacer post having a base member, a shaft and a breakaway connection between the base member and the shaft;

the base member is generally planar and has a top surface, a bottom surface, a peripheral edge extending thereabout, and a plurality of spacedly arrayed through holes are defined in the base member and communicate between the top surface and the bottom surface, and plural predetermined surface features are carried on the top surface and extend generally vertically upwardly therefrom, each of the plural predetermined surface features having a top end portion, a predetermined height dimension between the top end portion and the top surface of the base member, a predetermined a thickness dimension, and a predetermined position relative to the others of the plural predetermined surface features; and the breakaway connection is between a bottom end portion of the shaft and the top end portion of plural predetermined surface features of the base member, and the breakaway connection provides a predetermined and intentional fracture location where the shaft is separable from the base member;

the shaft is generally cylindrical and elongate and has a top end portion, a bottom end portion, an exterior circumferential surface, a diameter and defines a longitudinal axis, and a plurality of predetermined and spacedly arrayed surface features are defined on the exterior circumferential surface between the top end portion and the bottom end portion, and the plurality of predetermined and spacedly arrayed surface features include two circumferentially spaced apart groupings of a plurality of vertically aligned and vertically spaced apart partial threads, each of the partial threads having a first end portion and a second end portion, a top surface, a bottom surface and a predetermined slope relative to the longitudinal axis, and two circumferentially spaced apart vertical slide channels are defined on the exterior circumferential surface of the shaft, and each of the two vertical slide channels space apart the two groupings of the plurality of partial threads from one another;

a leveler that releasably and adjustably engages with the spacer post, the leveler having a friction plate, a foot ring and an engager;

the friction plate is annular and has a top surface, a bottom surface, an outer circumferential edge defining an outer diameter, a medial hole having an inner circumferential edge defining an inner diameter, an axis, and an O-ring groove is defined in the bottom surface to releasably carry an O-ring therein, and an annular slide track is defined in the top surface for slidable engagement with the foot ring, the annular slide track having a radially extending retaining lip at a circumferential edge to maintain the foot ring in axially rotational slidable engagement with the slide track;

the foot ring is annular and has a top surface, a bottom surface that frictionally slidably communicates with the slide track of the friction plate, an outer circumferential edge defining an outer diameter and having a lip, a medial hole having an inner circumferential edge defining an inner diameter, and an axis, and plural spaced apart engager legs are structurally carried on the top surface, and each of the plural spaced apart engager legs has a bottom portion interconnected with the top surface of the foot ring, a top portion, opposing lateral side portions, and a predetermined height dimension between the top portion and the bottom portion; and the engager has a body that is structurally interconnected with the top portion of each of the plural spaced apart engager legs, and the body has a top, a bottom, a medial cylindrical portion, and an outer circumferential edge that defines gripping features to enhance gripping by a user, and each of the plural spaced apart gripping features has a dimensionally thickened outer edge portion, and the medial cylindrical portion has a barrel portion that defines a medial channel that defines an axis and has an interior diameter, and the barrel portion has an outer circumferential surface and an inner circumferential surface within the medial channel, and the inner circumferential surface defines a plurality of predetermined and spacedly arrayed surface features, and the plurality of predetermined and spacedly arrayed surface features include two circumferentially spaced apart groupings of a plurality of vertically aligned and vertically spaced apart, partial threads, each partial thread having a first end portion and a second end portion, a top surface, a bottom surface and a predetermined slope relative to the axis of the medial channel, and two vertical slide channels are defined in the interior circumferential surface of the medial channel, and the two vertical slide channels are circumferentially spaced apart from one another, and an alignment indicator is defined on the top surface of the body and the alignment indicator identifies the location of the predetermined surface features within the medial channel; and the leveler is both axially slidably and rotatably threadably engageable with the spacer post shaft.

9. The tile lippage control and tile spacing system of claim 8 and further comprising:

a spacer member between the bottom end portion of the shaft and the top end portions of plural predetermined surface features of the base member, and wherein the spacer member is generally planar and has a first side and a second side with a predetermined thickness dimension therebetween, a first lateral edge, a second lateral edge, a top end portion and a bottom end portion with a predetermined height dimension therebetween, and the top end portion is structurally interconnected to the bottom end portion of the shaft, and the bottom end portion of the spacer communicates with the top end portions of the predetermined surface features of the base member to form the breakaway connection.

10. The lippage control and tile spacing system of claim 9 and further comprising:

a radially enlarged shoulder carried at the bottom end portion of the shaft, and the radially enlarged shoulder is structurally interconnected with the top end portion of the spacer member.

11. A method for controlling tile lippage and controlling tile spacing in setting tiles in a substrate, comprising the steps:

providing a surface that is at least partially covered with the substrate;

providing at least two tiles to be placed adjacent one another in the substrate with a predetermined distance between adjacent edge portions of the at least two tiles;

providing a spacer post having a base member, a shaft, and a breakaway connection between the shaft and the base member;

the base member is generally planar and has a top surface, a bottom surface, a peripheral edge extending thereabout, and a plurality of spacedly arrayed through holes are defined in the base member and communicate between the top surface and the bottom surface, and plural predetermined surface features are carried on the top surface and extend generally vertically upwardly therefrom, each of the plural predetermined surface features having a top end portion, a predetermined height dimension, a predetermined a thickness dimension, and a predetermined position relative to the others of the predetermined surface features; and the breakaway connection is between a bottom end portion of the shaft and the base member, and the breakaway connection provides a predetermined and intentional fracture location where the shaft is separable from the base member;

the shaft is generally cylindrical and elongate and has a top end portion, a bottom end portion, an exterior circumferential surface, a diameter and defines a longitudinal axis, and a plurality of predetermined and spacedly arrayed surface features are defined on the exterior circumferential surface between the top end portion and the bottom end portion, and the plurality of predetermined and spacedly arrayed surface features include a plurality of vertically aligned and vertically spaced apart partial threads, each of the partial threads having a first end portion and a second end portion, a top surface, a bottom surface and a predetermined slope relative to the longitudinal axis, and an axial slide channel defined on the exterior circumferential surface of the shaft, and the axial slide channel is adjacent the first end portion of the plurality of partial threads;

placing a first tile in the substrate in a predetermined position;

placing the base member of the spacer post in the substrate and positioning a portion of the generally planar base member under one edge of the placed first tile so that some amount of substrate flows into and through the plurality of spacedly arrayed through holes defined in the generally planar base portion and an edge portion of the placed first tile is in direct frictional contact with the predetermined surface features carried on the top surface of the generally planar base portion; and the shaft extends vertically upwardly adjacent the edge of the first placed tile;

placing a second tile in the substrate immediately adjacent the predetermined surface features carried on the top surface of the generally planar base portion of the base member that was previously placed in the substrate, and at least partially underneath the edge of the first placed tile, and aligning the second tile immediately adjacent the predetermined surface features so that a predetermined thickness dimension of each of the predetermined surface features provides spacing between the first and second placed tiles, and so that the shaft extends vertically upwardly from the space between the first and second placed tiles;

providing a leveler that releasably and adjustably engages with the spacer post shaft, the leveler having a friction plate, a foot ring and an engager;

and wherein the friction plate is annular and has a top surface, a bottom surface, an outer circumferential edge defining an outer diameter, a medial hole having an inner circumferential edge defining an inner diameter, an axis, and an O-ring groove is defined in the bottom surface to releasably carry a friction enhancing and scuff resistant O-ring therein, and an annular slide track is defined in the top surface for slidable engagement with the foot ring, the annular slide track having a radially extending retaining lip at a circumferential edge to maintain the foot ring in axially rotational slidable engagement with the slide track:

the foot ring is annular and has a top surface, a bottom surface that frictionally slidably communicates with the slide track of the friction plate, an outer circumferential edge defining an outer diameter having a lip, a medial hole having an inner circumferential edge defining an inner diameter, and an axis, and plural spaced apart engager legs are structurally carried on the top surface, and each of the plural spaced apart engager legs has a bottom portion interconnected with the top surface of the foot ring, and the top portion, opposing lateral side portions and a predetermined height dimension between the top portion and the bottom portion; and the engager has a body and the body is structurally interconnected with the top portion of each of the plural spaced apart engager legs, and the body has a top, a bottom, a medial cylindrical portion and an outer circumferential edge that defines gripping features to enhance gripping by a user, and each of the plural spaced apart gripping features has a dimensionally thickened outer edge portion, and medial cylindrical portion has a barrel portion that defines a medial channel having an axis, and that has an interior diameter, and the barrel portion has an outer circumferential surface and an inner circumferential surface within the medial channel, and the inner circumferential surface defines a plurality of predetermined and spacedly arrayed surface features, and the plurality of predetermined and spacedly arrayed surface features include a plurality of vertically aligned and vertically spaced apart, partial threads, each partial thread having a first end portion and a second end portion, a top surface, a bottom surface and a predetermined slope relative to the axis of the medial channel, and an axial slide channel is defined in the interior circumferential surface of the medial channel, and the slide channel is adjacent the first end portion of the plurality of partial threads, and an alignment indicator is defined on the top surface of the body and the alignment indicator identifies the location of the predetermined surface features within the medial channel;

positioning the leveler adjacent above the top end portion of the spacer post shaft so that the leveler axis is coaxially aligned with the shaft axis and so that the plurality of vertically aligned and vertically spaced apart partial threads defined on the shaft are axially aligned with the axial slide channel defined in the interior circumferential surface of the engager, and axially slidably engaging the leveler onto the spacer post shaft and moving the leveler axially along the spacer post shaft without axial rotation of the leveler relative to the spacer post shaft until the O-ring carried on the bottom surface of the friction plate contacts the top surface of both the first and the second placed tiles; and axially rotating the engager about the spacer post shaft a partial turn so that the plurality of vertically aligned and vertically spaced apart partial threads defined on the shaft threadably engage with the plurality of vertically aligned and vertically spaced apart partial threads defined on the interior circumferential surface of the medial channel of the engager, so that the foot ring axially rotates within the slide track defined in the top surface of the friction plate, while the friction plate remains stationary on the first and second placed tiles so as to not mar/scuff/damage the tiles, and the leveler and friction plate are moved vertically downwardly along the spacer post shaft into closer proximity to the base member with the first and second placed tiles therebetween, responsively reducing lippage between the first and second placed tiles while maintaining spacing between the first and second placed tiles;

allowing an amount of time to pass to allow the substrate to harden/cure and to positionally secure the first and second placed tiles in the substrate;

intentionally striking the leveler and spacer post shaft with a blow sufficient to cause the spacer post shaft to separate from the base member at the break-away connection between the shaft and the base member, and permanently leaving the base member in the hardened/cured substrate below the adjacent first and second placed tiles;

placing grout in the space between the first and second placed tiles to fill the space and cover the portion of the breakaway connection remaining between the first and second placed tiles; and removing the separated shaft from the leveler so that the leveler may be reused.

* * * * *